US012061041B2

(12) United States Patent
Almaguer et al.

(10) Patent No.: US 12,061,041 B2
(45) **Date of Patent: *Aug. 13, 2024**

(54) DISPLAY CASE DOOR WITH SEALED GLASS UNIT AND ELECTRONIC DISPLAY

(71) Applicant: Anthony, Inc., Sylmar, CA (US)

(72) Inventors: Pedro Almaguer, North Hills, CA (US); Mark Sandnes, Granada Hills, CA (US); David Briggs Baugh, Palmdale, CA (US); Dexter Maluto, Los Angeles, CA (US); Adrian Rodriguez, Santa Clarita, CA (US)

(73) Assignee: Anthony, Inc., Sylmar, CA (US)

( * ) Notice: Subject to any disclaimer, the term of this patent is extended or adjusted under 35 U.S.C. 154(b) by 220 days.

This patent is subject to a terminal disclaimer.

(21) Appl. No.: 17/683,004

(22) Filed: Feb. 28, 2022

(65) Prior Publication Data

US 2023/0180948 A1 Jun. 15, 2023

Related U.S. Application Data

(60) Provisional application No. 63/287,930, filed on Dec. 9, 2021.

(51) Int. Cl.
*F25D 23/00* (2006.01)
*A47F 3/00* (2006.01)
(Continued)

(52) U.S. Cl.
CPC ..... *F25D 23/028* (2013.01); *A47F 3/001* (2013.01); *A47F 3/0434* (2013.01); *A47F 11/06* (2013.01);
(Continued)

(58) Field of Classification Search
CPC ..... F25D 23/00; F25D 23/006; F25D 23/02; F25D 23/028; F25D 23/063;
(Continued)

(56) References Cited

U.S. PATENT DOCUMENTS

D263,835 S 4/1982 Ahrens
6,148,563 A * 11/2000 Roche ..... E05C 17/24 49/501
(Continued)

FOREIGN PATENT DOCUMENTS

CA 3013728 2/2019
CN 209121756 7/2019
(Continued)

OTHER PUBLICATIONS

[No Author Listed], ".093/(2.36) Housings, Plug and Receptacle, 12 CKT, .198/(5.03)CTR," Molex, Nov. 13, 2014, 2 pages.
(Continued)

*Primary Examiner* — Chi Q Nguyen
(74) *Attorney, Agent, or Firm* — Fish & Richardson P.C.

(57) ABSTRACT

A display case door includes a sealed glass unit assembly, a door frame, and an electronic display. The sealed glass unit assembly includes a sealed glass unit and a subframe extending about and coupled to the sealed glass unit. The subframe includes a set of two or more subframe rails configured to hold the sealed glass unit. The door frame is coupled to the subframe and configured to support the sealed glass unit assembly in the door frame. The electronic display is coupled to the door frame in front of the sealed glass unit. The door frame is configured to couple with a display case enclosure in an opening of the display case enclosure.

23 Claims, 19 Drawing Sheets

(51) Int. Cl.

| | |
|---|---|
| ***A47F 3/04*** | (2006.01) |
| ***A47F 11/06*** | (2006.01) |
| ***F25D 23/02*** | (2006.01) |
| ***F25D 29/00*** | (2006.01) |

(52) U.S. Cl.
CPC ..... *F25D 29/005* (2013.01); *F25D 2323/02* (2013.01); *F25D 2400/36* (2013.01)

(58) Field of Classification Search
CPC .... F25D 23/064; F25D 23/065; F25D 29/005; F25D 29/00; F25D 2323/02; F25D 2400/36; A47F 3/00; A47F 3/001; A47F 3/005; A47F 3/0434; A47F 3/0426; A47F 3/043; A47F 11/00; A47F 11/06
See application file for complete search history.

(56) References Cited

U.S. PATENT DOCUMENTS

| | | | | |
|---|---|---|---|---|
| D474,486 | S | 5/2003 | Uihlein et al. | |
| D544,277 | S | 6/2007 | Hoyvik | |
| D760,820 | S | 7/2016 | Lee et al. | |
| D768,738 | S | 10/2016 | Lee et al. | |
| D769,948 | S | 10/2016 | Lee et al. | |
| D787,571 | S | 5/2017 | Seo et al. | |
| D826,291 | S | 8/2018 | Lim et al. | |
| D826,295 | S | 8/2018 | Lee | |
| D839,325 | S | 1/2019 | Lee et al. | |
| 10,174,994 | B2 * | 1/2019 | Kim | F25D 23/025 |
| D840,443 | S | 2/2019 | Aulisio | |
| 11,047,613 | B1 * | 6/2021 | Park | A47B 96/201 |
| D928,853 | S | 8/2021 | Kim et al. | |
| 11,320,192 | B2 * | 5/2022 | Lee | F25D 23/028 |
| D959,326 | S | 8/2022 | Kim et al. | |
| 11,402,147 | B2 * | 8/2022 | Lee | F25D 23/02 |
| 11,512,895 | B2 * | 11/2022 | Lee | F25D 23/028 |
| 11,650,628 | B1 * | 5/2023 | Nicholson | G06F 3/044 361/679.01 |
| 11,768,027 | B2 * | 9/2023 | Lee | F25D 23/02 312/405 |
| 11,867,450 | B2 * | 1/2024 | Lee | F25C 5/22 |
| 2014/0132146 | A1 * | 5/2014 | Kim | F25D 23/02 312/405.1 |
| 2016/0123654 | A1 | 5/2016 | Lee et al. | |
| 2016/0153221 | A1 | 6/2016 | Dodge et al. | |
| 2018/0292127 | A1 * | 10/2018 | Park | F25D 27/005 |
| 2019/0050900 | A1 | 2/2019 | Avakian | |
| 2019/0122263 | A1 | 4/2019 | Avakian | |
| 2019/0208925 | A1 | 7/2019 | Kim et al. | |
| 2019/0221144 | A1 | 7/2019 | Artwohl et al. | |
| 2020/0256612 | A1 | 8/2020 | Avakian et al. | |
| 2020/0300538 | A1 | 9/2020 | Avakian et al. | |
| 2020/0326119 | A1 * | 10/2020 | Lee | F25D 23/02 |
| 2021/0041161 | A1 | 2/2021 | Avakian | |
| 2021/0366005 | A1 | 11/2021 | Avakian et al. | |
| 2023/0184481 | A1 | 6/2023 | Almaguer et al. | |
| 2023/0184485 | A1 | 6/2023 | Baugh et al. | |
| 2023/0225065 | A1 * | 7/2023 | Sandnes | H05K 5/03 49/70 |

FOREIGN PATENT DOCUMENTS

| | | |
|---|---|---|
| WO | WO 2019/032893 | 2/2019 |
| WO | WO 2020/131881 | 6/2020 |
| WO | WO 2021/150406 | 7/2021 |

OTHER PUBLICATIONS

International Preliminary Report on Patentability in International Appln. No. PCT/US2021/036413, dated Dec. 22, 2022, 12 pages.
International Search Report and Written Opinion in International Appln. No. PCT/US2021/036413, dated Oct. 26, 2021, 15 pages.
International Search Report and Written Opinion in International Appln. No. PCT/US2022/081179, dated Mar. 30, 2023, 15 pages.
Invitation to Pay Additional Fees in International Appln. No. PCT/US2021/036413, dated Aug. 17, 2021, 2 pages.
Office Action in Canadian Appln. No. 3,150,495, dated Apr. 12, 2023, 6 pages.
Office Action in Canadian Appln. No. 3,150,502, dated Apr. 12, 2023, 7 pages.
Office Action in Canadian Appln. No. 3,150,511, dated Apr. 11, 2023, 4 pages.

* cited by examiner

DISPLAY CASE DOOR WITH SEALED GLASS UNIT AND ELECTRONIC DISPLAY

CROSS REFERENCE TO RELATED APPLICATIONS

This application claims priority to, and the benefit of, U.S. Application Ser. No. 63/287,930, filed on Dec. 9, 2021, and entitled "Electronic Display Mounting in Display Case Door," the entire contents of which is incorporated by reference herein.

TECHNICAL FIELD

This invention relates to thermally insulated doors for temperature-controlled enclosures.

BACKGROUND

Refrigerated enclosures are used in commercial, institutional, and residential applications for storing and/or displaying refrigerated or frozen objects. Refrigerated enclosures may be maintained at temperatures above freezing (e.g., a refrigerator) or at temperatures below freezing (e.g., a freezer). Refrigerated enclosures have one or more thermally insulated doors or windows for viewing and accessing refrigerated or frozen objects within a temperature-controlled space. Doors for refrigerated enclosures generally include thermally insulated glass panel assemblies.

SUMMARY

The present disclosure relates to a display case door for a refrigerated enclosure.

In a general aspect, a display case door includes a sealed glass unit assembly, a door frame, and an electronic display. The sealed glass unit assembly includes a sealed glass unit and a subframe extending about and coupled to the sealed glass unit. The subframe includes a set of two or more subframe rails configured to hold the sealed glass unit. The door frame is coupled to the subframe and configured to support the sealed glass unit assembly in the door frame. The electronic display is coupled to the door frame in front of the sealed glass unit. The door frame is configured to couple with a display case enclosure in an opening of the display case enclosure.

In some implementations, at least one of the subframe rails defines a channel configured to receive an edge of the sealed glass unit.

In some implementations, at least one of the subframe rails includes a front rim. The front rim is secured to the door frame.

In some implementations, the door frame includes one or more rails, at least one of the rails of the door frame includes an inner rim, and the front rim of at least one of the subframe rails is coupled to the inner rim.

In some implementations, at least one of the subframe rails includes high-loaded polymer, and the door frame includes one or more rails including an aluminum alloy.

In some implementations, at least one of the subframe rails includes a front rim and defines a channel. The channel is configured to receive an edge of the sealed glass unit. The front rim extends outwardly from the channel and is coupled to the door frame.

In some implementations, the door frame further includes a back cover coupled to at least one of the subframe and the door frame. The back cover includes a slot configured to hold a gasket such that the gasket contacts a sealing surface on the display case enclosure when the display case door is installed on the display case enclosure.

In some implementations, at least a portion of the sealed glass unit is recessed relative to a sealing surface of the display case enclosure when the display case door is installed on the display case enclosure.

In some implementations, the display case further includes a back cover including a body and a blade. The body is coupled with at least one of the subframe and the door frame, the body defining a slot configured to receive a gasket. The blade extends from the body. A distal portion of the blade is configured to contact an outer surface of at least one of the subframe rails when the back cover is installed on at least one of the subframe and the door frame.

In some implementations, the display case further includes a thermally conductive material at least partially covering a front surface of at least one of the two or more subframe rails.

In some implementations, the display case door further includes a sealant between at least one of the subframe rails and a corresponding rail of the door frame.

In some implementations, the display case door further includes two or more self-clinching studs configured to couple at least one of the subframe rails to the door frame.

In some implementations, the display case door further including one or more bezels coupled to the door frame. The electronic display assembly includes one or more sensors along an edge of the electronic display. At least one of the bezels defines a cutout for at least one of the one or more sensors.

In some implementations, the display case door further including one or more cable assemblies configured to supply electrical power to the electronic display and one or more heaters for the display case door. At least one of the cable assemblies includes a switch operable by a user to turn off power to the electronic display.

In some implementations, the display case door further including one or more cable assemblies configured to supply electrical power to the electronic display and one or more heaters for the display case door. At least one of the rails includes a service access opening for at least one of the cable assemblies.

In some implementations, the display case door includes one or more heater wires coupled to at least one of the rails.

In some implementations, the display case door further including one or more left side mounting blocks coupled to the door frame and one or more right side mounting blocks coupled to the door frame. The electronic display is coupled to at least one of the one or more left side mounting blocks. The electronic display is coupled to at least one of the one or more right side mounting blocks. The electronic display is at least partially supported in the door frame on at least one of one or more left side mounting blocks and at least one of the one or more right side mounting blocks.

In some implementations, at least one of the left side mounting blocks or the right side mounting blocks includes a spacer plate configured to define a lateral spacing of the electronic display with respect to the door frame.

In some implementations, at least one of the rails of the door frame includes an inner rim. At least one of the two or more mounting blocks is coupled to the inner rim.

In some implementations, the door frame includes one or more display supports. The electronic display further includes one or more hangers configured to couple with at least one of the display supports. The hangers are configurable to support the electronic display in the door frame.

In a general aspect, a rail system for a display case door includes a rear rail and a front rail. The rear rail is configured to hold an edge of a sealed glass unit of the display case door. The front rail coupled to the rear rail. At least one of the front rail and rear rail is configurable to couple with a gasket such that the gasket contacts a sealing surface on a display case enclosure when the display case door is coupled to the display case enclosure.

In some implementations, the rear rail is included in a subframe for the sealed glass unit. The front rail is included in a door frame. The subframe is configurable to couple with the door frame to support the sealed glass unit in the door frame.

In some implementations, the rear rail defines a channel configured to receive an edge of the sealed glass unit.

In some implementations, the rear rail includes a front rim extending outwardly from the channel. The front rail is configured to couple with the front rim.

In some implementations, the rail system further includes a back cover. The back cover including a body and a blade. The body is coupled with at least one of the rear rail and the front rail. The body defining a slot configured to receive a gasket. The blade extends from the body. A distal portion of the blade is configured to contact an outer surface of the rear rail when the back cover is installed on at least one of the subframe and the door frame.

In some implementations, the rear rail includes high-loaded polymer, and the front rail includes an aluminum alloy.

In some implementations, the rail system further includes a thermally conductive material disposed on at least a portion of a front surface of the rear rail.

In a general aspect, a method of making a display case door includes installing two or more subframe rails on a sealed glass unit to form a subframe around the sealed glass unit; and coupling each of at least one of the two or more subframe rails to a corresponding rail of a door frame to install the sealed glass unit in the door frame.

In some implementations, at least one of the two or more subframe rails includes a channel installing the two or more subframe rails on the sealed glass unit to form a subframe around the sealed glass unit includes installing an edge of the sealed glass unit in the channel.

In some implementations, at least one of the two or more subframe rails includes a front rim. Coupling each of at least one of the two or more subframe rails to the corresponding rail of the door frame to install the sealed glass unit in the door frame; includes securing the front rim of the subframe rail to a corresponding rail of the door frame.

In some implementations, the method further includes installing a back cover on at least one of the subframe and the door frame. The back cover is configured to hold a gasket.

In some implementations, the method further includes installing a thermally conductive material on a front surface of at least one subframe rail.

In some implementations, the method further includes installing an electronic display on the door frame in front of the sealed glass unit.

The method further includes installing the display case door on a display case enclosure.

In a general aspect, a display case door includes a sealed glass unit assembly, a door frame, and an electronic display. The sealed glass unit assembly a sealed glass unit one or more rear rails coupled to the sealed glass unit. The sealed glass unit including three or more panes of glass spaced from one another. The door frame includes two or more front rails. At least one of the rear rails is coupled to at least one of the front rails. The electronic display is coupled to the door frame in front of the sealed glass unit. The door frame is configured to couple with a display case enclosure in an opening of the display case enclosure.

In some implementations, at least a portion of the sealed glass unit is recessed relative to a sealing surface of the display case enclosure when the display case door is installed on the display case enclosure.

In some implementations, at least one of the rear rails includes high-loaded polymer, and one or more of the front rails includes an aluminum alloy.

In some implementations, at least one of the rear rails defines a channel configured to receive an edge of the sealed glass unit.

In a general aspect, a rail system for a display case door includes a rear rail, a front rail, a back cover, and a gasket. The rear rail is configured to hold an edge of a sealed glass unit of the display case door. The front rail is coupled to the rear rail. The back cover is coupled to at least one of the front rail and the rear rail. The gasket is coupled to the back cover. The gasket is configured to contact a sealing surface on a display case enclosure when the display case door is coupled to the display case enclosure.

In some implementations, the front rail is configured to couple with an edge of an electronic display.

In some implementations, the back cover includes a rear surface and defines a slot. The gasket is coupled in the slot on the rear surface of the back cover.

In some implementations, the back cover includes a body and a blade. The body is coupled with at least one of the rear rail and the front rail. The body defines a slot configured to receive a gasket. The blade extends from the body. A distal portion of the blade is configured to contact an outer surface of the rear rail when the back cover is installed on at least one of the subframe and the door frame.

In some implementations, the back cover includes a blade. The blade includes a distal tip. The distal tip is configured to bear against an outer surface of the rear rail when the back cover is coupled to at least one of the front rail and the rear rail.

In some implementations, contact between the blade and an outer surface of the rear rail inhibits condensation on the display case door when the display case door is installed on a refrigerated enclosure.

In some implementations, the rear rail includes high-loaded polymer, and the front rail includes an aluminum alloy.

In some implementations, the rail system further includes a thermally conductive material disposed on at least a portion of a front surface of the rear rail.

In some implementations, the thermally conductive material on the front surface of the rear rail includes tape.

In some implementations, the thermally conductive material on the front surface of the rear rail inhibits condensation on the display case door when the display case door is installed on a refrigerated enclosure.

In some implementations, the rear rail defines a channel configured to receive an edge of the sealed glass unit.

In some implementations, the rear rail includes a front rim extending outwardly from the channel. The front rail is configured to couple with the front rim.

In a general aspect, a rail system for a display case door includes a rear rail, a front rail, and a back cover. The rear rail is configured to hold an edge of a sealed glass unit. The front rail coupled to the rear rail. The back cover includes a body and a blade. The body is configured to couple with at least one of the rear rail and the front rail. The body defining a slot configured to receive a gasket. The blade extends from the body. A distal portion of the blade is configured to contact the outer surface of the rear rail when the back cover is installed on at least one of the front rail and the rear rail.

In some implementations, the distal portion of the blade of the back cover is configured to be deflected by the rear rail when the back cover is installed on at least one of the front rail and the rear rail.

In some implementations, the blade is angled relative to an outer surface of the rear rail when the back cover is installed on at least one of the front rail and the rear rail.

In some implementations, the distal portion of the blade of the back cover includes a flexible material.

In some implementations, the body of the back cover includes a first polymeric material. At least the distal portion of the blade of the back cover includes a second polymeric material that is more flexible than the first polymeric material.

In some implementations, the back cover is produced by co-extrusion such that at least the distal portion of the blade includes a material that is more flexible than the body of the back cover.

In some implementations, the distal portion includes a flexible PVC elastomer.

In a general aspect, a rail system for a display case door includes a rear rail, a front rail, and a thermally conductive material. The rear rail is configured to hold an edge of a sealed glass unit of the display case door. The front rail is coupled to rear rail. The thermally conductive material at least partially covers a front surface of the rear rail.

In some implementations, the thermally conductive element includes a metal tape.

In some implementations, the thermally conductive element includes an aluminum tape with a thermally conductive adhesive.

In some implementations, the thermally conductive element includes a coating.

In some implementations, the thermally conductive element is configured to conduct heat from the front rail.

In some implementations, the thermally conductive material on the front surface of the rear rail is configured to inhibit condensation on the front surface of the rear rail.

In some implementations, the thermally conductive material is in contact with the front rail.

In some implementations, the thermally conductive material is thermally coupled to the front rail.

In some implementations, the front rail includes an aluminum alloy. The thermally conductive material substantially covers the front surface of the rear rail between a front glass surface of the sealed glass unit and a front rail.

In some implementations, the rear rail includes a polymer.

In some implementations, the rear rail includes a high loaded polymer.

In some implementations, the front rail includes an aluminum alloy.

In some implementations, the rail system includes a back cover and a gasket. The back cover is coupled to at least one of the front rail and the rear rail. The gasket is coupled the back cover. In some implementations, the gasket is configured to contact a sealing surface on a refrigerated enclosure when the display case door is coupled to the refrigerated enclosure.

In a general aspect, a display case door includes an insulated panel assembly, one or more rear rails, a door frame, an electronic display, and a wire harness. The one or more rear rails are coupled to the insulated panel assembly. The door frame includes two or more front rails. The electronic display is coupled to the door frame in front of the insulated panel assembly. The wire harness is configured to supply electrical power to the electronic display. At least one of the one or more rear rails is coupled to at least one of the one or more front rails. The door frame is configured to couple with a display case enclosure in an opening of the display case enclosure.

In some implementations, at least one of the front rails includes one or more wireways. A portion of the wire harness passes through at least one of the wireways in at least one front rail.

In some implementations, the wire harness includes one or more branches configured to supply electrical power to the electronic display, one or more branches configured to supply electrical power to one or more door rail heaters, and one or more branches configured to supply electrical power to one or more glass heaters.

In some implementations, the wire harness is configurable to connect and disconnect power individually to each of the electronic display, at least one of the rail heaters, and at least one of the glass heaters.

In some implementations, the wire harness includes one or more branches configured to supply electrical power to one or more sensors of the electronic display.

In some implementations, the wire harness includes one or more switches operable by a user to switch power to the electronic display on and off.

In some implementations, at least one of the switches is on a bottom rail of the door frame.

In some implementations, the wire harness includes one or more branches configured to transmit data to and from the electronics display.

In some implementations, at least one of the two or more front rails includes one or more cable access openings adjacent to a portion of the wire harness.

In some implementations, a first portion of the wire harness passes through a wireway on the left side of the electronic display, and a second portion of the wire harness passes through a wireway on the right side of the electronic display.

In some implementations, the wire harness includes a hinge pin connector. Electrical power is supplied to the display case door through the hinge pin connector.

In some implementations, the insulated panel assembly includes a sealed glass unit includes three or more panes of glass.

In some implementations, at least a portion of the sealed glass unit is recessed relative to a sealing surface of the display case enclosure when the display case door is installed on the display case enclosure.

In a general aspect, a display case door includes an insulated panel assembly, a door frame, an electronic display, and a wire harness. The door frame includes two or more rails coupled to the insulated panel assembly. The electronic display is coupled to the door frame in front of the insulated panel assembly. The wire harness is configured to supply electrical power to the electronic display. The door frame is configured to couple with a display case enclosure in an opening of the display case enclosure. At least one of the two or more rails includes one or more wireways. At least a portion of the wire harness passes through at least one of the one or more wireways in at least one rail. At least one rail includes one or more cable access openings adjacent to a portion of the wire harness.

In some implementations, the display case door includes a cover configured to couple in at least one of the one or more cable accessing openings.

In a general aspect, a display case door includes an insulated panel assembly, a door frame, and one or more bezels. The door frame includes two or more rails coupled to the insulated panel assembly. The electronic display is coupled to the door frame in front of the insulated panel assembly. The one or more bezels are configured to couple to the door frame on one or more edges of the electronic display. The door frame is configured to couple with a display case enclosure in an opening of the display case enclosure. The electronic display includes one or more sensors along an edge of the electronic display. At least one of the bezels defines one or more cutouts for at least one of the one or more sensors.

In some implementations, at least one of the one or more bezels includes a flat plate. At least a portion of at least one of the cutouts is in the flat plate.

In some implementations, at least one of the one or more cutouts is a notch along an edge of the bezel.

In some implementations, at least one of the one or more cutouts is an aperture in the bezel.

In some implementations, at least a portion of at least one of the one or more sensors protrudes through at least one of the one or more cutouts.

In some implementations, at least one of the sensors includes a camera.

In some implementations, at least one of the sensors includes a TOF sensor.

In some implementations, at least one of the bezels is configured to cover at least a portion of a mounting block between the electronic display and at least one of the rails of the door frame.

Particular implementations of the subject matter described in this specification can be implemented so as to realize one or more of the following advantages.

Implementations of the present disclosure may improve the maintainability of electronic displays mounted to a display case door. For example, implementations of the present disclosure may provide for easy replacement or maintenance of SGU assemblies.

Implementations of the present disclosure may reduce handling costs and simplify logistics.

Implementations of the present disclosure may simplify display case door removal and increase the safety of the operation.

Implementations of the present disclosure may reduce a risk of condensation on a display case door.

Implementations of the present disclosure may provide a single system that complies with governmental requirements for both normal temperature and low temperature applications (e.g., Department of Energy requirements).

Implementations of the present disclosure may reduce a risk of installing a normal temperature door into a low temperature opening, which may result in condensation.

The details of one or more embodiments of the invention are set forth in the accompanying drawings and the description below. Other features, objects, and advantages of the invention will be apparent from the description and drawings, and from the claims.

DETAILED DESCRIPTION

Figure 1:
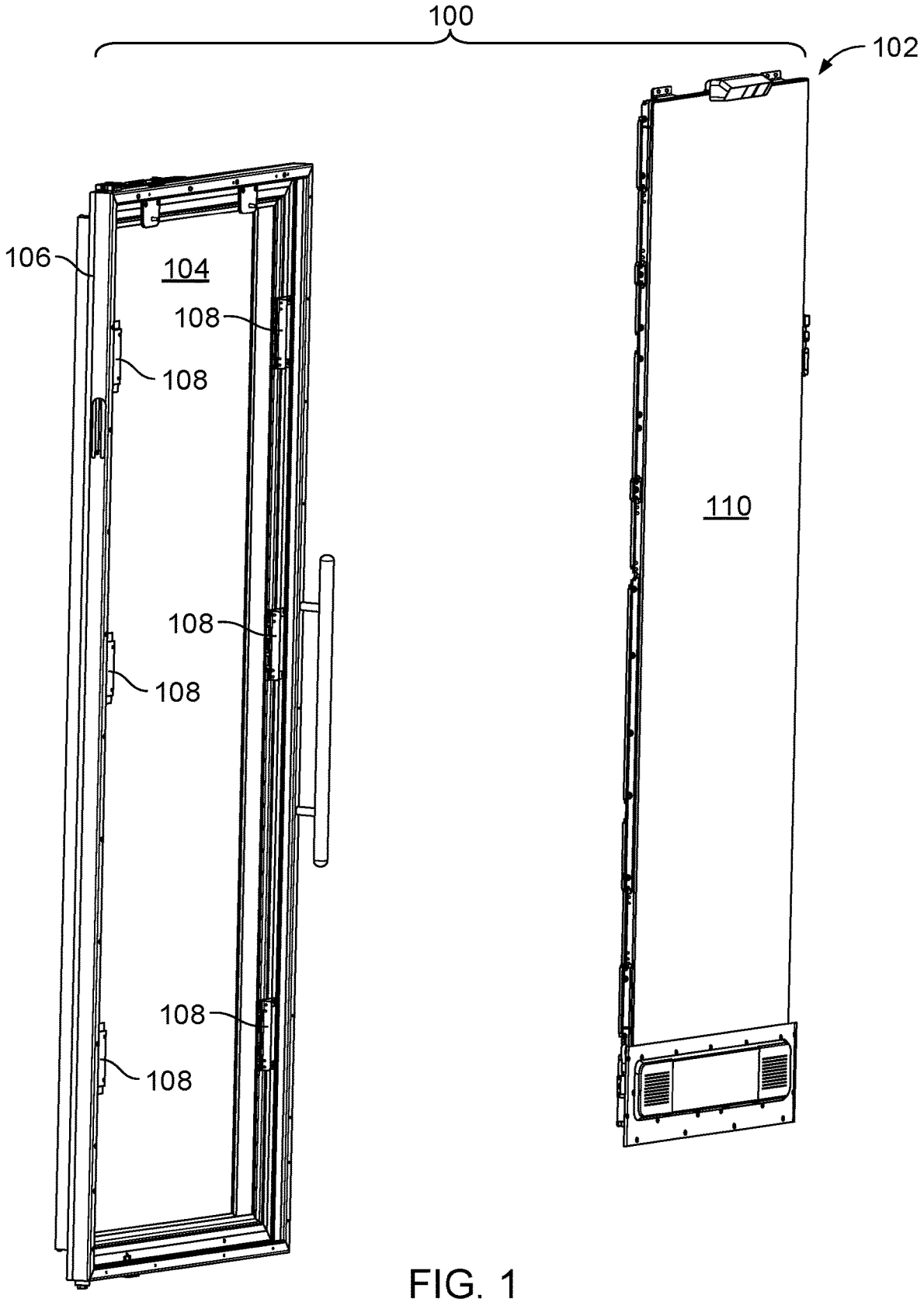
FIG. 1 is an exploded perspective view of an exemplary electronic display case door according to some implementations of the present disclosure.

FIG. 1 is an exploded perspective view of an exemplary arrangement of an electronic display assembly 102 in a display case door 100 according to implementations of the present disclosure. FIG. 1 illustrates an exemplary display case door 100 that can be installed in a refrigerated display case such as a refrigerator, a freezer, or other enclosure defining a temperature-controlled space. Display case door 100 includes an insulated panel assembly 104 or transparent panel, a door frame 106 secured to an edge of insulated panel assembly 104, and mounting blocks 108. Mounting blocks are coupled to door frame 106. The display case door 100 include an electronic display assembly 102 that is coupled to door frame 106 by way of mounting blocks 108. Electronic display assembly 102 can be mounted to door frame 106 so as to overlay all or a majority of insulated panel assembly 104. Electronic display assembly 102 includes electronic display 110.

In some implementations, a display case door includes one or more bezels (omitted from FIG. 1 for clarity). The bezels can cover all or a portion of the mounting blocks and other components for mounting the electronic display assembly 102. The bezels can create a recognized UL wireway.

Insulated panel assembly 104 can include one or more panes of glass. In some implementations, insulated panel assembly 104 includes two or more layers of transparent panes bounding a sealed space in between, forming a sealed glass unit (SGU).

In some implementations, the gap or sealed space can between two or more panels can be filled with an insulating gas such as a noble gas (e.g., Argon, Krypton, etc.) which functions as a thermal insulator to reduce heat transfer through the panel. In some examples, the sealed space can be evacuated below atmospheric pressure.

Door frame 106 extends around and is secured to a peripheral edge of insulated panel assembly 104. As further described in detail below, door frame 106 defines a channel or tunnel that receives one or more power cables that provide electrical power to the electronic display assembly.

Display case door 100 can include a single electronic display or multiple electronic displays. For example, display case door 100 can include two or more electronic displays vertically stacked and together covering the insulated panel assembly 104.

Electronic display 110 can include, but is not limited to, a liquid crystal display (LCD), a light emitting diode (LED) display, an organic light emitting diode (OLED) display, a field emission display (FED), a plasma display panel (PDP), or an electroluminescent (EL) display. For example, electronic display 110 can be a smart television with streaming capabilities for receiving content over a wireless network (e.g., a Wi-Fi network). Electronic display 110 is generally opaque and, when mounted on the display case door 100 partially or completely obstructs the view through the insulated panel assembly 104. In some implementations, electronic display 110 can be a custom sized display configured to correspond with dimensions of the display case door 100. In some implementations, electronic display 110 can be a commercial off the shelf (COTS) display.

Figure 2:
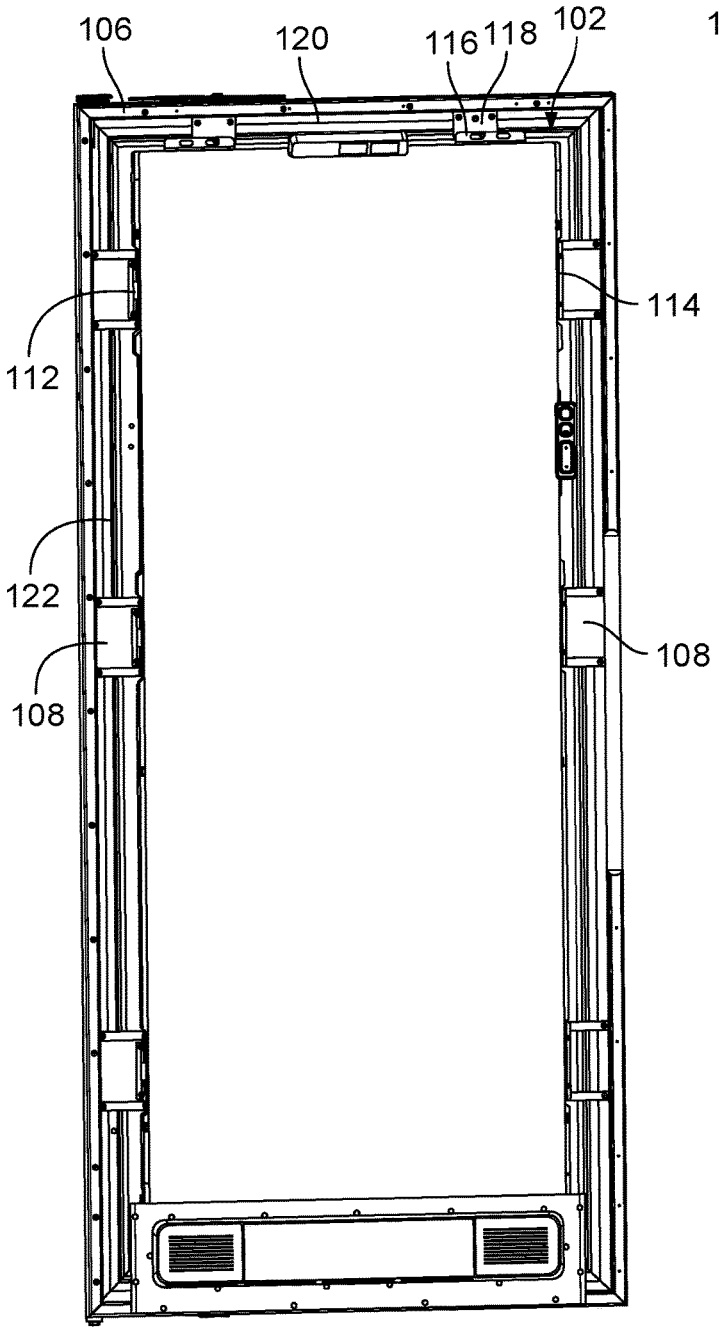
FIG. 2 is a perspective view of the electronic display case door of FIG. 1 with an electronic display mounted in a door frame.
Figure 2A:
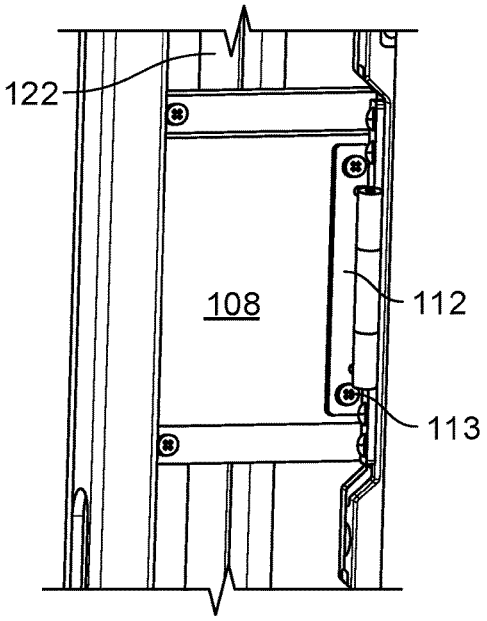
FIGS. 2A and 2B are perspective detail views illustrating mounting of the electronic display assembly.
Figure 2B:
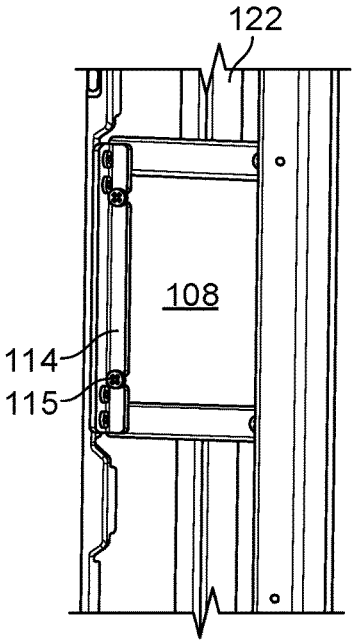

FIG. 2 is a perspective view of the electronic display case door of FIG. 1 with electronic display assembly 102 mounted in door frame 106. FIG. 2A is a perspective detail view illustrating mounting of the electronic display assembly 102 on the left side of the electronic display. FIG. 2B is a perspective detail view illustrating mounting of the electronic display assembly 102 on the right side of the electronic display.

Electronic display assembly 102 includes electronic display 110, left side hinge brackets 112, right side brackets 114, and hangers 116. Left side hinge brackets 112 are attached to electronic display 110 along the left side of electronic display 110. Right side brackets 114 are attached to electronic display 110 along the right side of electronic display 110. Each of left side hinge brackets 112 and right side brackets 114 is secured to a corresponding one of mounting blocks 108 by way of screws 113 and screws 115, respectively. Door frame 106 includes top rail 120 and side rails 122. Electronic display assembly 102 is mounted on mounting blocks 108 on the left side rail 122 of door frame 106 and mounting blocks 108 on the right side rail 122 of door frame 106. Each of hangers 116 can be coupled on a corresponding one of display supports 118.

In the example shown in FIG. 2, electronic display assembly 102 includes three left side hinge brackets 112 and three right side brackets 114. In other examples, an electronic display is secured to a door frame with fewer or more than three brackets and/or corresponding mounting blocks coupled to a door frame. In one example, an electronic display is coupled by way of only one bracket and a corresponding mounting block on each side of the electronic display.

Figure 3:
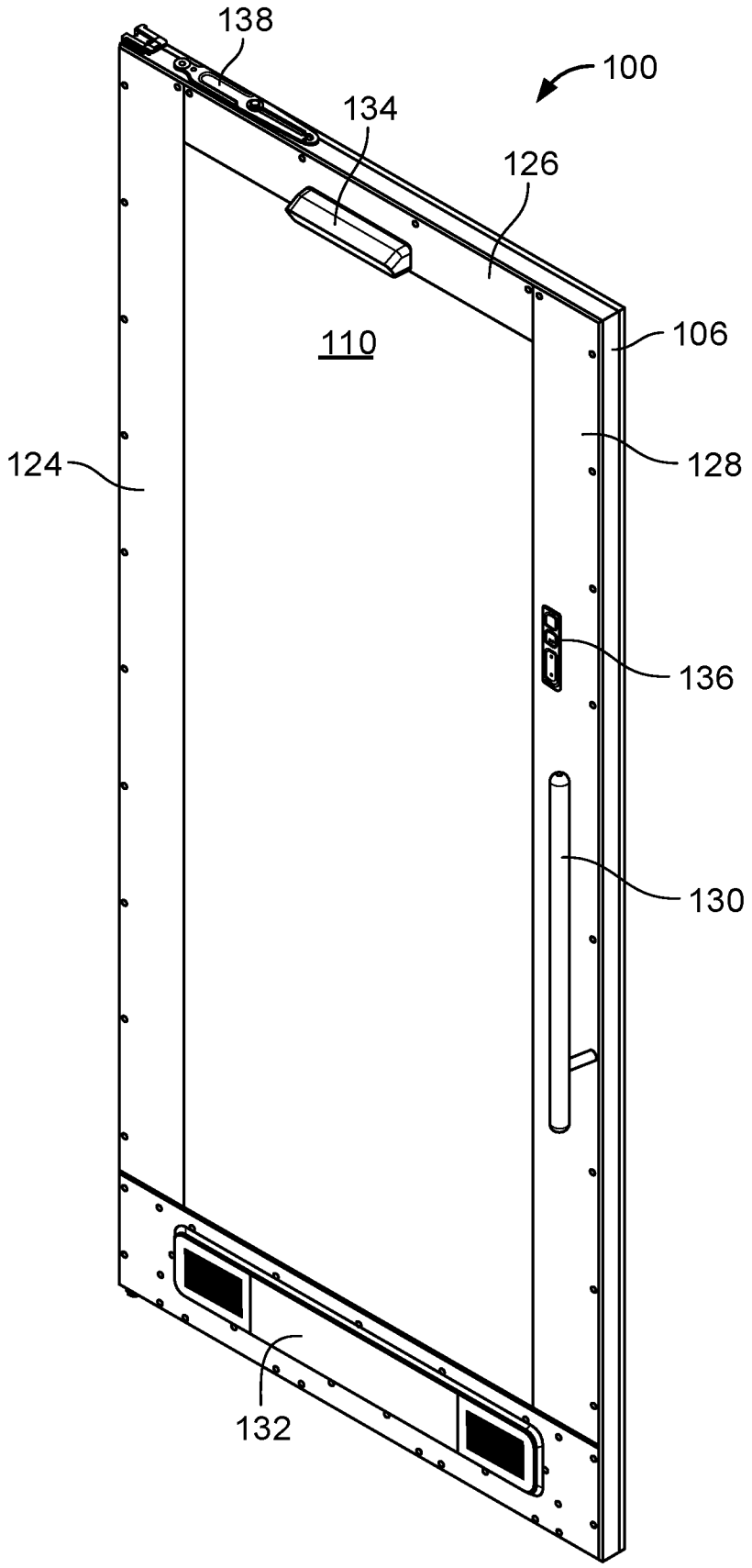
FIG. 3 is a perspective view of the electronic display case door of FIG. 1 with the electronic display assembly mounted in door frame with bezels installed.

FIG. 3 is a perspective view of the electronic display case door of FIG. 1 with electronic display assembly 102 mounted in door frame 106, with bezels installed around the edges of door frame 106. Display case door 100 includes left bezel 124, top bezel 126, and right bezel 128. Each of left bezel 124, top bezel 126, and right bezel 128 overlay and conceal a portion of mounting blocks 108, left side hinge brackets 112, right side brackets 114, hangers 116, and display supports 118.

Display case door 100 includes handle 130. Electronic display assembly 102 includes circuitry module 132, top sensor 134, and handle-side sensor 136. The outside edges of circuitry module 132 are secured to left rail 206 and right rail 208 of door frame 106. Left bezel 124 and right bezel 128 can be attached to their respective rails. Top sensor 134 passes through an opening or cutout in top bezel 126. Handle-side sensor 136 is accessible through a corresponding aperture in right bezel 128.

Hold open bracket 138 is provided on a top edge of display case door 100. One end of hold open bracket 138 is pivotally coupled to door frame 106. In service, hold open bracket 138 can be used to maintain door in a desired open position.

Circuitry module 132 is positioned in a bottom portion of door frame 106. Circuitry module 132 overlays a portion of insulated panel assembly 104. Circuitry module 132 can be attached to electronic display 110 such that, with electronic display 110 releasably coupled to door frame 106, circuitry module 132 is releasably coupled to door frame 106. Circuitry module 132 can include a media player in electronic communication with electronic display 110 to control media content presented on electronic display 110.

Figure 4:
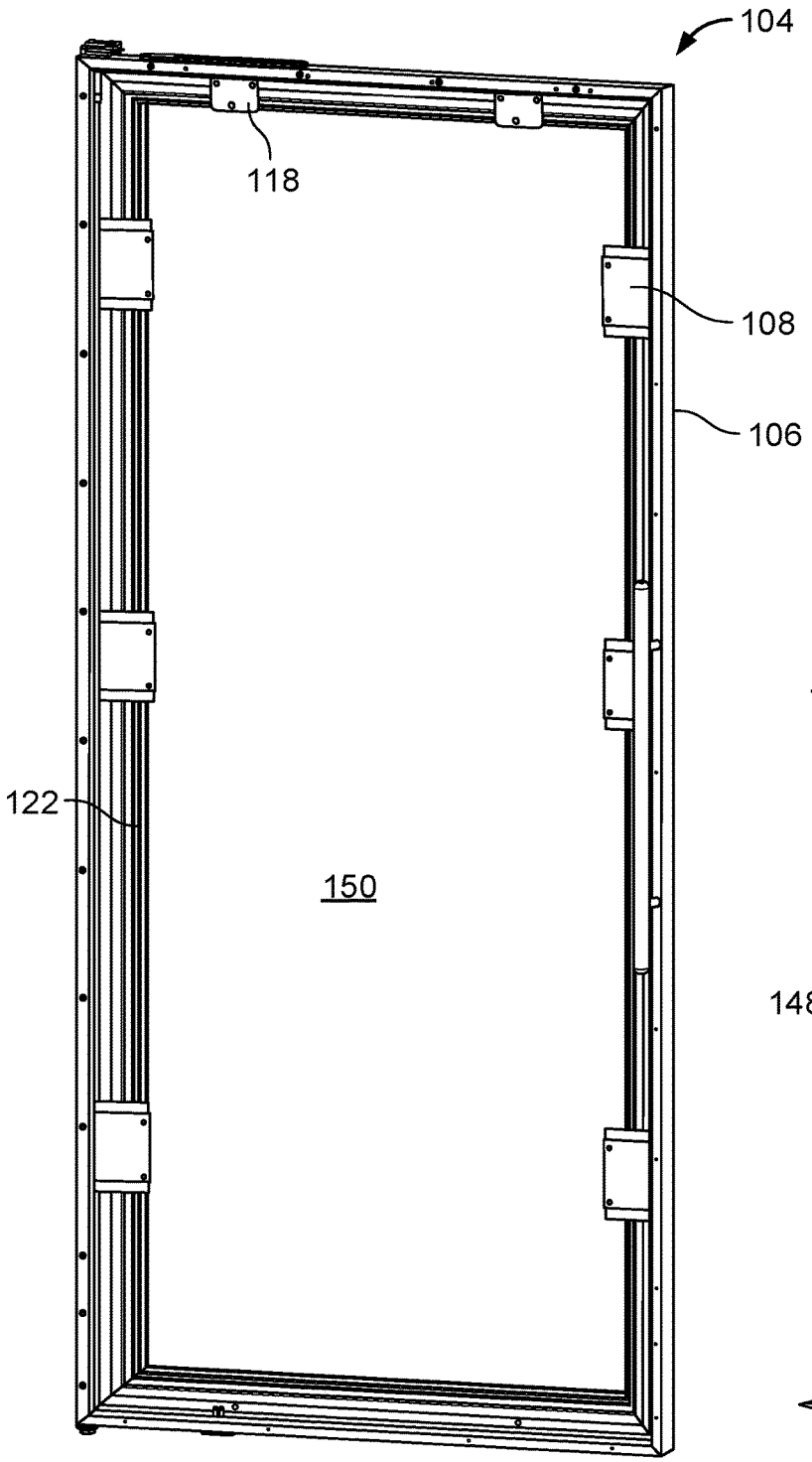
FIG. 4 is a perspective view illustrating a display case door with the electronic display assembly removed.
Figure 4A:
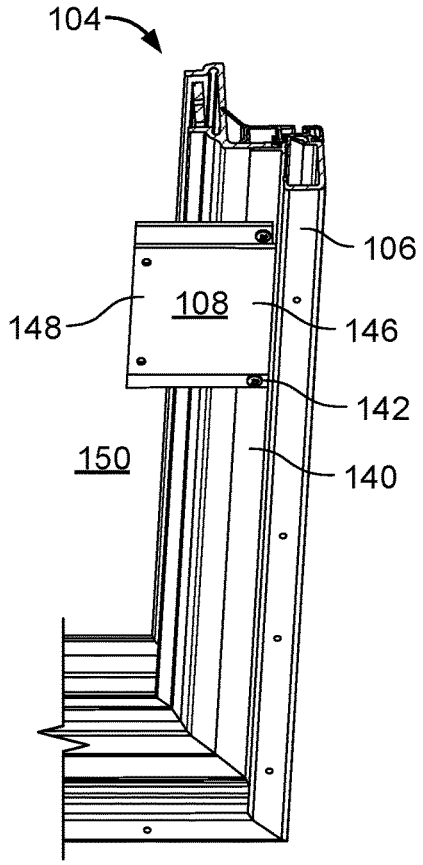
FIG. 4A is a perspective view of a portion of a door frame illustrating installation of a mounting block in a door frame.

FIG. 4 is a perspective view illustrating display case door 100 with electronic display assembly 102 removed. FIG. 4A is a perspective view of a portion of a door frame 106 illustrating one of mounting blocks 108. Mounting block 108 is secured to an inner rim 140 of door frame 106 by way of fasteners 142. Each of mounting blocks 108 extends inwardly from door frame 106. Mounting block 108 is secured to inner rim 140 of door frame 106 by way of fasteners 142 at an outer end 146 of mounting block 108. In some implementations, inner rim 140 includes internally threaded holes for receiving fasteners 142. The internally threaded holes can be in the form of threaded inserts installed at one or more locations on inner rim 140. In some implementations, the internally threaded holes are tapped holes in inner rim 140.

In the example shown in FIG. 4A, mounting block 108 extends inwardly from door frame 106 in front of insulated panel assembly 104. The inside end 148 of mounting block 108 can extend over the glass panels 150 of insulated panel assembly 104.

Figure 5:
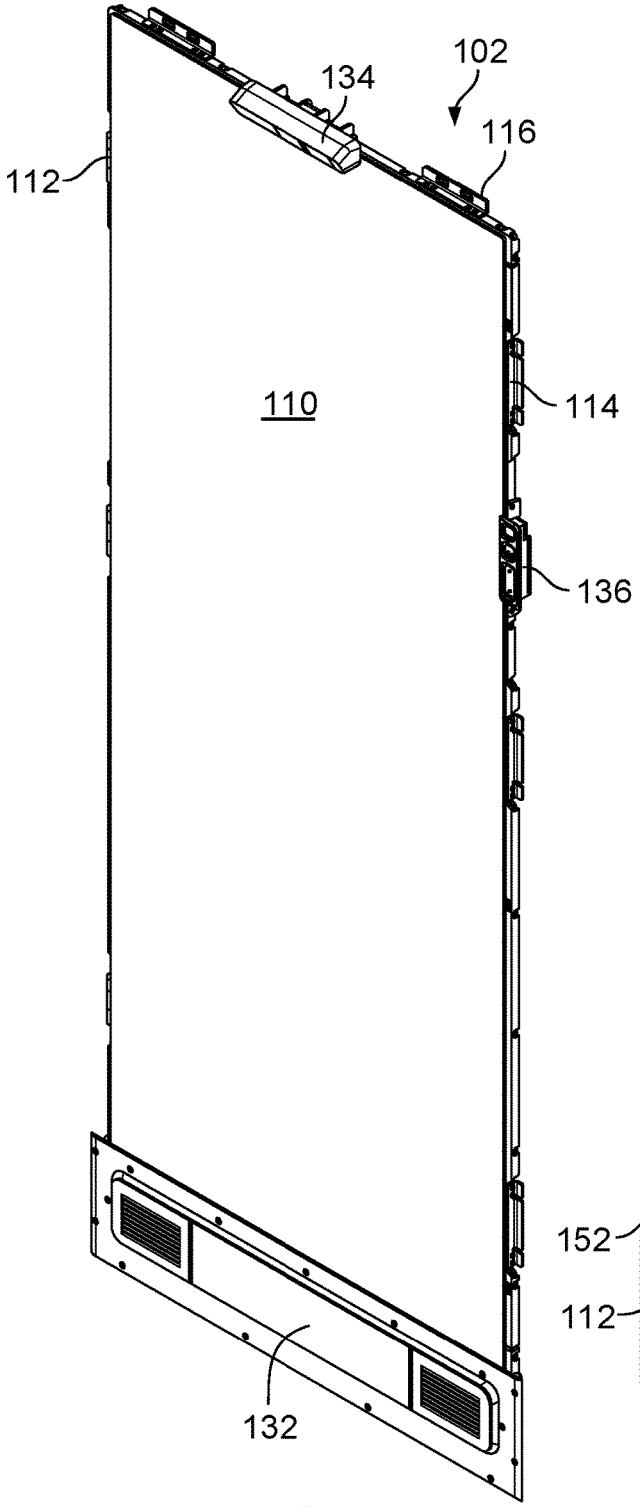
FIG. 5 is a perspective view of the electronic display assembly of FIG. 1.
Figure 5A:
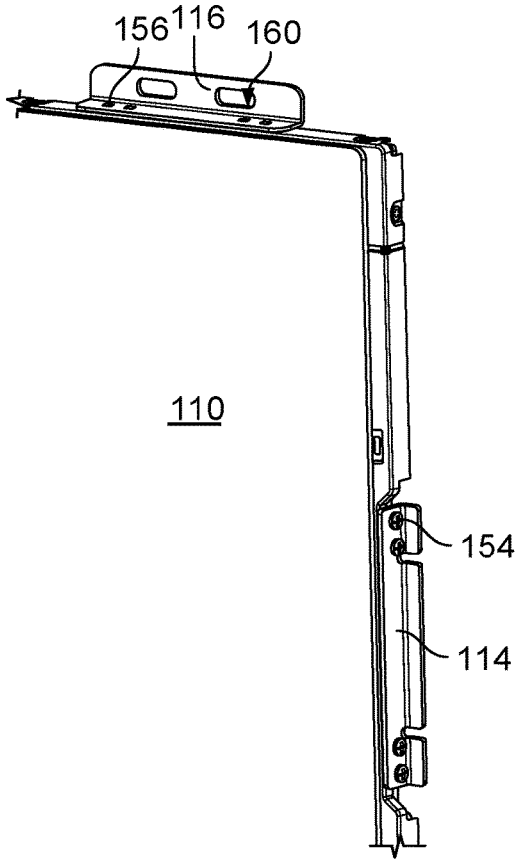
FIGS. 5A and 5B is a perspective detail views of portions illustrating portions of the electronic display assembly.
Figure 5B:
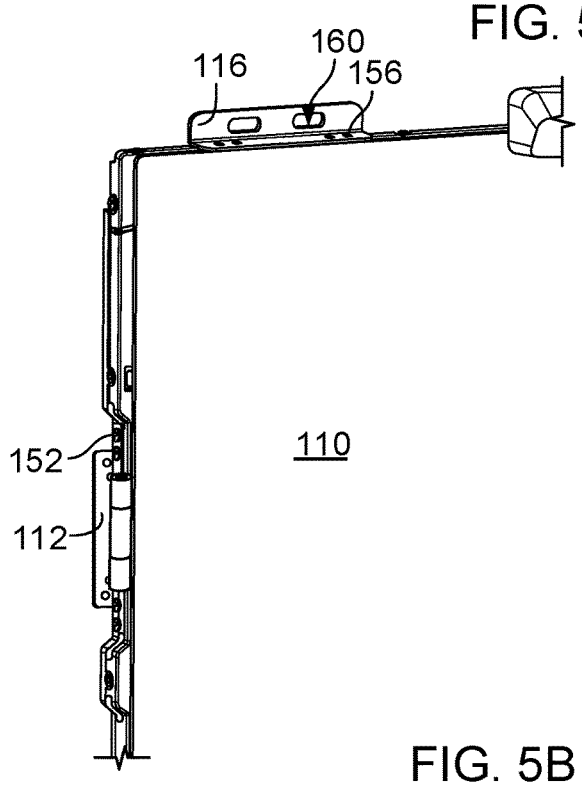

FIG. 5 is a perspective view of the electronic display assembly of FIG. 1. FIG. 5A is a perspective view of the upper right portion of the electronic display assembly. FIG. 5B is a perspective view of the upper left portion of the electronic display assembly. Left side hinge brackets 112 are attached to the left side of electronic display 110 by way of fasteners 152. Right side brackets 114 are attached to the right side of electronic display 110 by way of fasteners 154. Hangers 116 are attached to electronic display 110 by way of fasteners 156. Fasteners 152, 154, and 156 can be screws, bolts, rivets, or another type of fastener. Hangers 116 include slots 160.

Figure 6A:
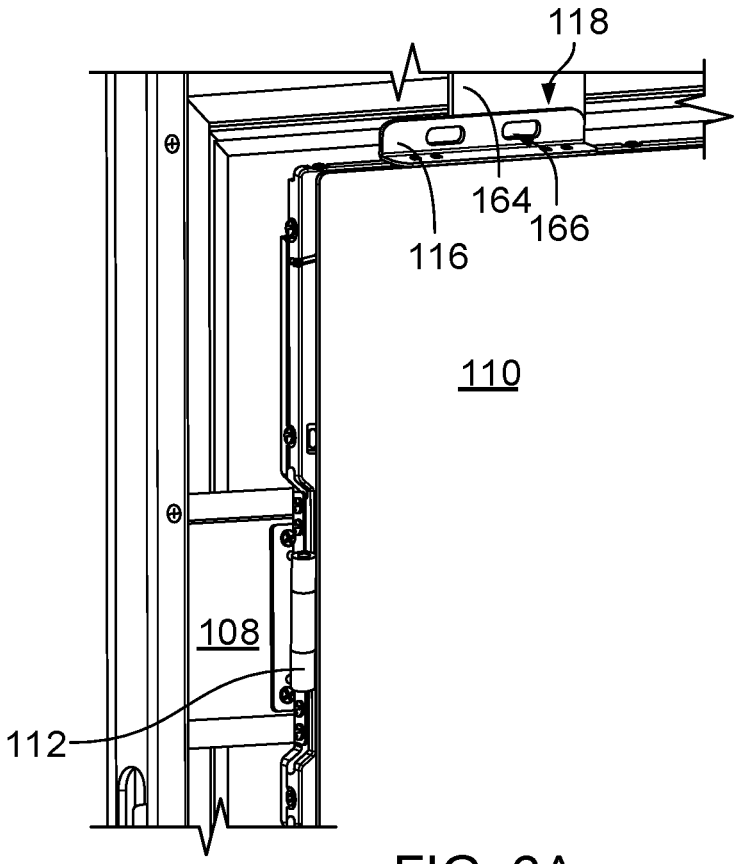
FIG. 6A is a perspective view of mounting of a left side hinge bracket on one of the mounting blocks looking inward toward the electronic display.
Figure 6B:
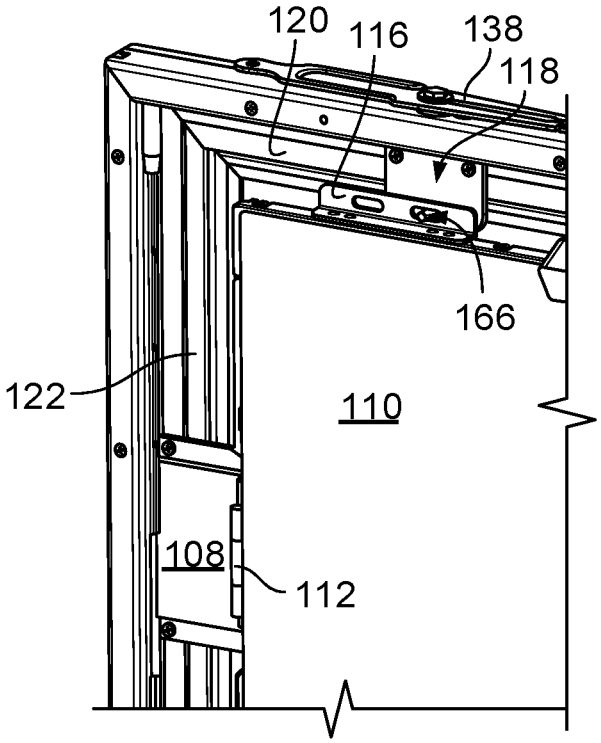
FIG. 6B is a perspective view of mounting of a left side hinge bracket on one of the mounting blocks looking outward toward the door frame.

In some implementations, one or more of the mounting blocks serve as a spacer plate. The mounting blocks can define a position of the electronic display relative to a door frame. FIG. 6A is a perspective view of mounting of left side hinge bracket 112 on one of mounting blocks 108 looking inward toward electronic display 110. FIG. 6B is a perspective view of mounting of left side hinge bracket 112 on one of mounting blocks 108 looking outward toward door frame 106. Mounting block 108 is attached to inner rim 140 of insulated panel assembly 104 at outer end 146 of mounting block 108. Left side hinge bracket 112 is secured to inside end 148 of mounting block 108 by way of screws 113. Right side brackets 114 can be secured in a similar manner to that shown in FIGS. 6A and 6B. In one example, screws 113 used to secure left side hinge brackets 112 and screws 115 used to secure right side brackets 114 are #6 pan-head screws.

Figure 7:
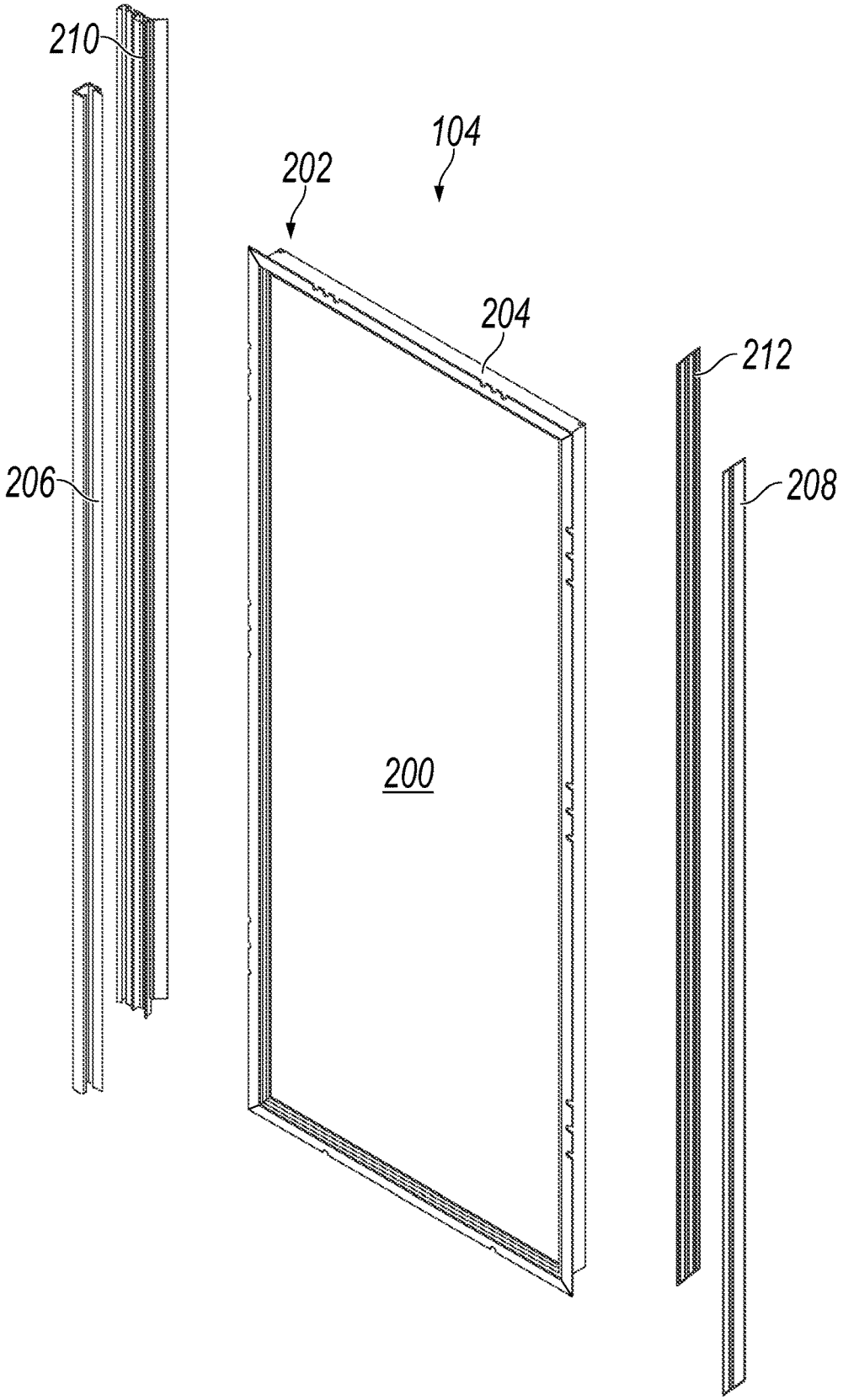
FIG. 7 is a partially exploded perspective view of the display case door of FIG. 1 illustrating the sealed glass unit assembly, side rails and side back covers according to some implementations.

FIG. 7 is a partially exploded perspective view of the display case door of FIG. 1 illustrating the sealed glass unit assembly, side rails and side back covers. (For illustrative purposes, the rails and other portions of the door frame are omitted from FIG. 7.) Sealed glass unit assembly 104 includes sealed glass unit 200 and SGU subframe 202. SGU subframe 202 includes a subframe rail 204 on each of the left, right, top and bottom edges of sealed glass unit 200. As will be described in further detail below, sealed glass unit 200 can include two or more panes of glass separated from one another by spacers.

To install sealed glass unit assembly 104 in door frame 106, each of the subframe rails 204 of sealed glass unit assembly 104 is secured to a corresponding rail of the door frame. For example, the one of left subframe rails 204 is coupled to left rail 206 and the right one of subframe rails 204 is coupled to right rail 208. Back cover 210 is coupled to left rail 206 and the adjacent subframe rail 204. Back cover 212 is coupled to right rail 208 and the corresponding subframe rail 204. In a similar manner, the top and bottom subframe rails can be secured to corresponding top and bottom rails of the door frame, and top and bottom back covers can be secured to the corresponding top and bottom rails of the door frame.

In this example, left rail 206 of door frame 106 (shown in FIG. 1) serves as a front rail for the display case door 100 and subframe rail 204 serves as a rear rail for the display case door. Back cover 210 is secured to left rail 206 and subframe rail 204.

Figure 8:
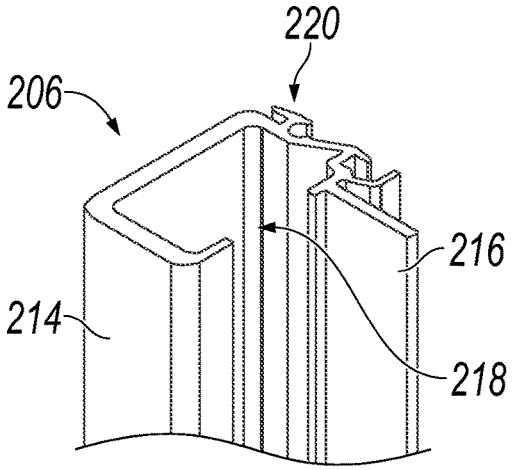
FIG. 8 is a cross sectional view of the left rail shown in FIG. 7.

FIG. 8 is a cross sectional view of left rail 206 shown in FIG. 7. Left rail 206 includes main rail section 214 and inner rim 216. Main rail section 214 defines interior channel 218. Tabs 220 are provided on a rear surface of main rail section 214. Tabs 220 can be used to couple left rail 206 with back cover 210.

Figure 9:
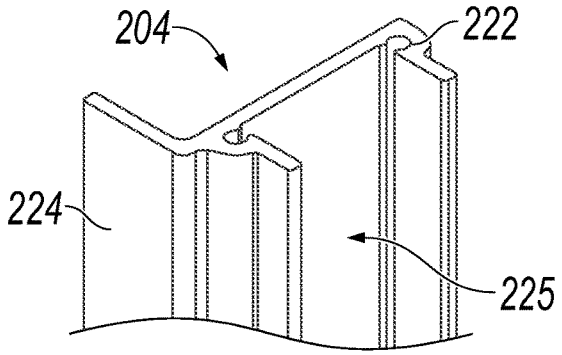
FIG. 9 is a cross sectional view of a subframe rail on the left side of the sealed glass unit assembly of FIG. 7.

FIG. 9 is a cross sectional view of subframe rail 204 on the left side of sealed glass unit assembly 104 in FIG. 7. Subframe rail 204 includes main rail section 222 and front rim 224. Front rim 224 extends outwardly from main rail section 222. Main rail section 222 defines channel 225. Channel 225 can receive an edge of sealed glass unit 200. Front rim 224 can include holes, studs, or other features for fastening securing front rim 224 to a rail of the door frame 106.

Figure 10:
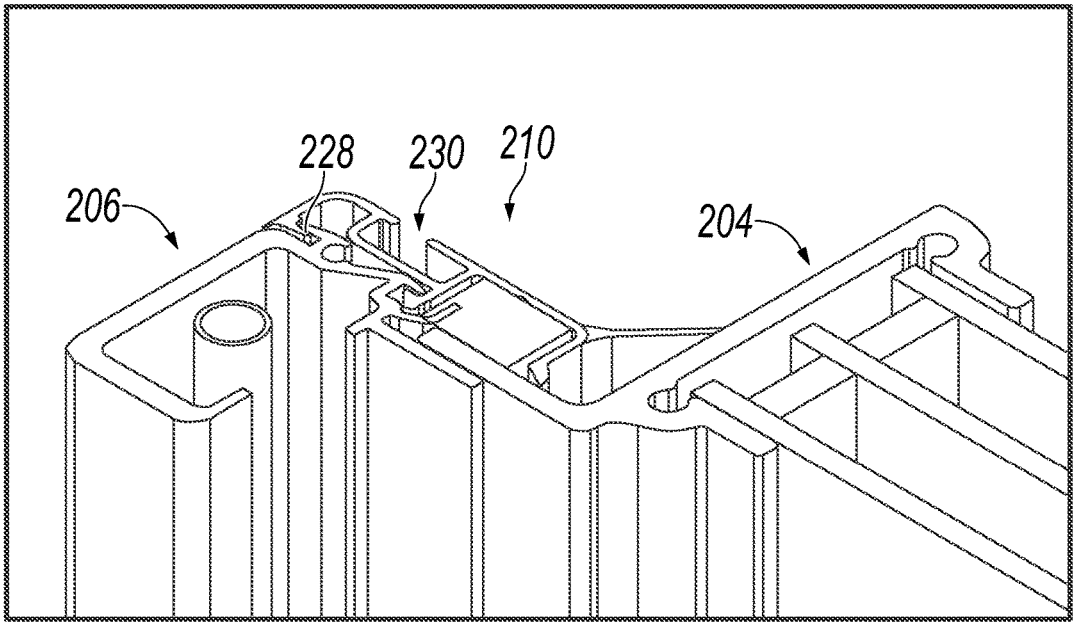
FIG. 10 is perspective cross sectional view of a connection between a door frame and an SGU assembly.

FIG. 10 is perspective cross sectional view of a connection between a door frame and an SGU assembly. Left rail 206 and subframe rail 204 are included in rail system 212. (Left rail 206 can be the left one of side rails 122 shown in FIG. 1). Rail system 212 can continue around the peripheral edge of sealed glass unit assembly 202, with a front rail coupled to a corresponding rear rail along each edge of the sealed glass unit assembly 202. Back cover 210 is coupled to rear side of left rail 206. Left back cover 210 includes tabs 228 and slot 230. Tabs 228 of back cover 210 engage with complementary tabs 220 of left rail 206.

Subframe rail 204 and left rail 206 can be coupled to one another by way of fasteners, such as screws or rivets. In one implementation, subframe rail 204 is attached using self-clinching studs. SGU assembly 202 is installed in the door frame by securing each of subframe rails 204 (left, right, top, and bottom) to a corresponding rail of door frame 106.

Figure 11:
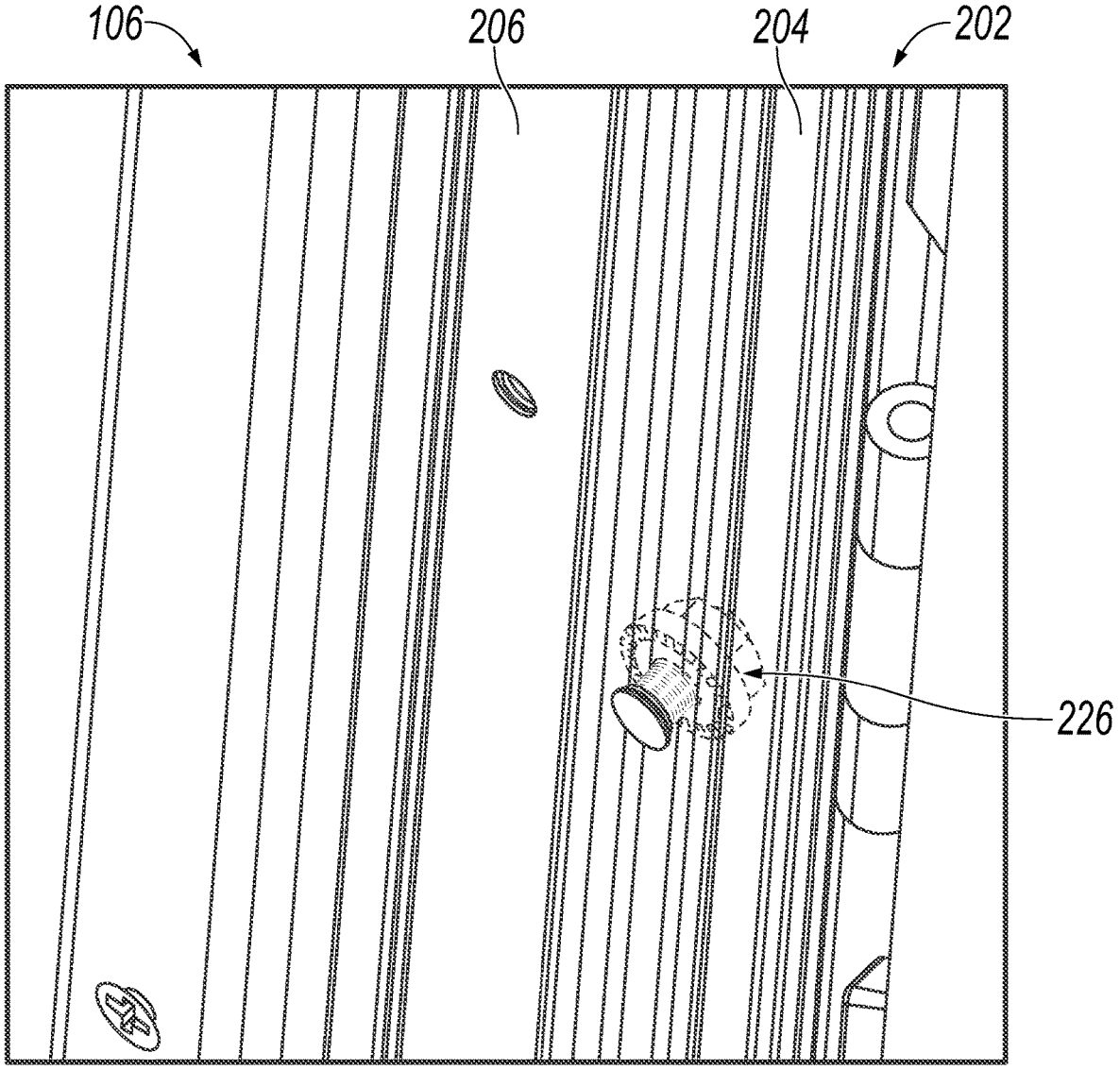
FIG. 11 is a perspective view illustrating studs for coupling a subframe for an SGU with a door frame of a display case door.

FIG. 11 is a perspective view illustrating studs for coupling a subframe for an SGU with a door frame of a display case door. In one implementation, studs 226 are installed on left rail 206 when the left rail 206 is fabricated. To couple sealed glass unit assembly 104 to door frame 106, sealed glass unit assembly 104 can be dropped down on studs 226. In some implementations, butyl tape is applied all around the rail between each subframe rail 204 of subframe 202 and the corresponding rails of door frame 106. In certain implementations, other sealing materials can be used, such as polyurethane. In some implementations, an adhesive or two-sided tape can be used to join subframe rails to a corresponding rail of a door frame (instead of, or in addition to, mechanical fasteners such as screws, studs, or rivets).

Figure 12:
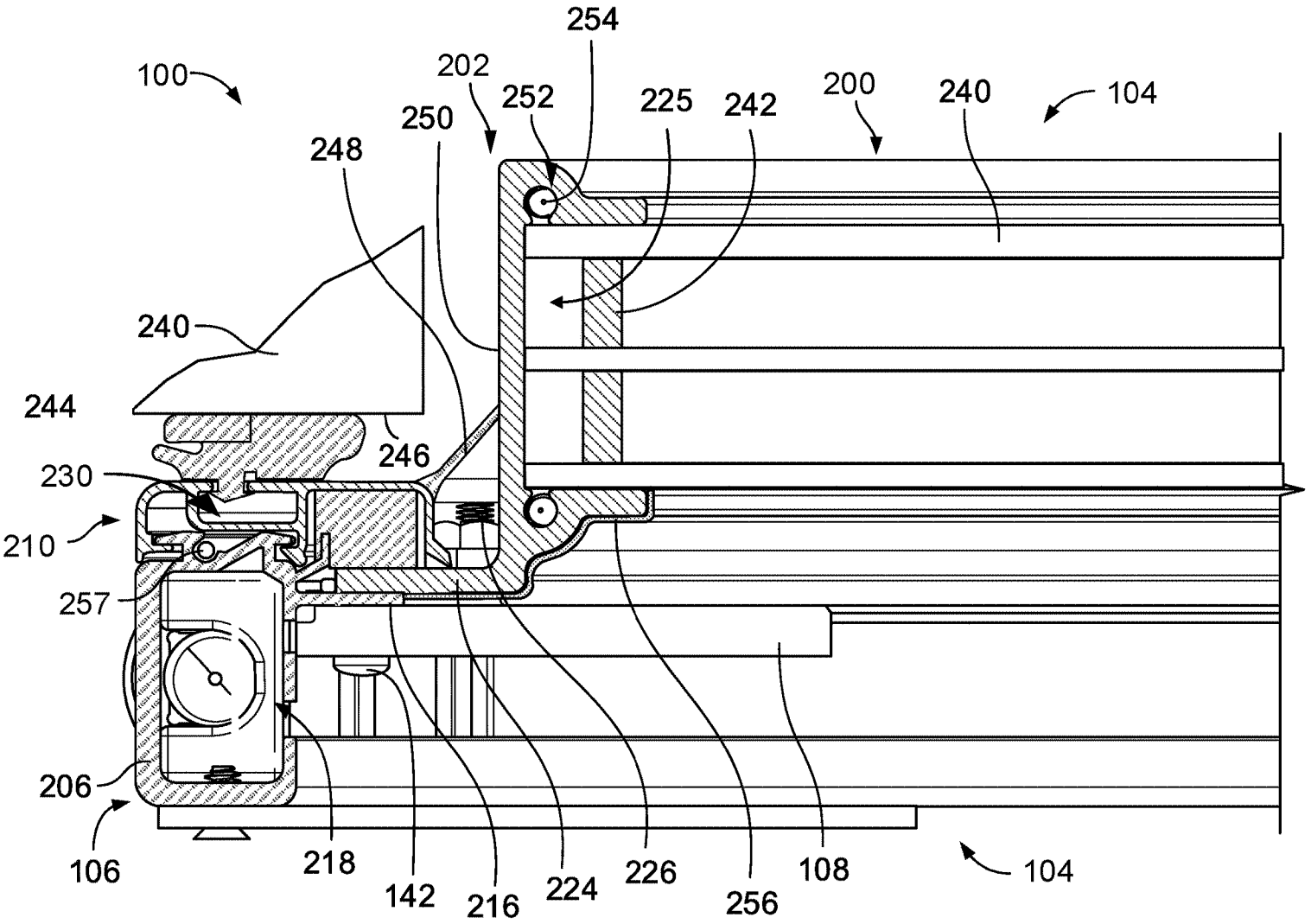
FIG. 12 is a cross sectional view of an installation of a display case door on a display case enclosure.

FIG. 12 is a cross sectional view of an installation of a display case door on a display case enclosure. Display case door 100 can be installed on display case enclosure 240. Display case door 100 can be mounted to display case enclosure 240 by way of a hinge system. In this case, display case door 100 can be swung open to access items in display case enclosure 240. In various implementations, a display case door includes features to reduce power consumption required to maintain surface temperatures above dew point.

Display case door 100 includes sealed glass unit assembly 104. Sealed glass unit assembly 104 is installed on door frame 106. In this example, front rim 224 of subframe rail 204 is contained between inner rim 216 of left rail 206 and the front face of back cover 210. In some implementations, subframe 204 is connected to left rail 206 by way of studs (for example, studs 226) and secured by way of a nuts installed on the studs.

Sealed glass unit 200 includes glass panes 240 and spacers 242. In the example shown in FIG. 12, sealed glass unit 200 includes three panes of glass. A sealed glass unit can nevertheless have, in other implementations, more or fewer than three panes of glass. In certain implementations, an insulated panel assembly is a vacuum insulated glass (VIG) assembly.

Back cover 210 is attached to left rail 206. Gasket 244 is installed in slot 230 of back cover 210. When display case door 100 is closed on display case enclosure 240, gasket 244 contacts sealing surface 246 of display case enclosure 240 to seal air in display case enclosure 240. In some implementations, sealing surface 246 is included on a frame installed in an opening in display case enclosure 240. Blade 248 of back cover 210 bears against an outer surface 250 of subframe rail 204. As will be further discussed below, blade 248 can serve as a thermal break for air in display case enclosure 240.

Sealed glass unit 200 can be at least partially recessed relative to the front of display case enclosure. In this example, two of the three panes 240 are to the rear of sealing surface 246 of display case enclosure 240.

Subframe rail 204 includes slots 252. Screws 254 can be installed in slots 252 to couple adjacent subframe rails 204 of SGU subframe 202 to secure SGU subframe 202 on sealed glass unit 200. Slots 252 can receive screws to join the miters of the subframe rail 204, which creates the SGU subframe 202.

Display case door 100 includes thermally conductive tape 256 on a front surface of subframe rail 204. As will be further described below, thermally conductive tape 256 can inhibit condensation on display case door 100. Heater wire 257 can be included between back cover 210 and left rail 206. In some implementations, sealed glass unit 200 includes one or more heater wires (omitted for clarity in FIG. 12).

Figure 13:
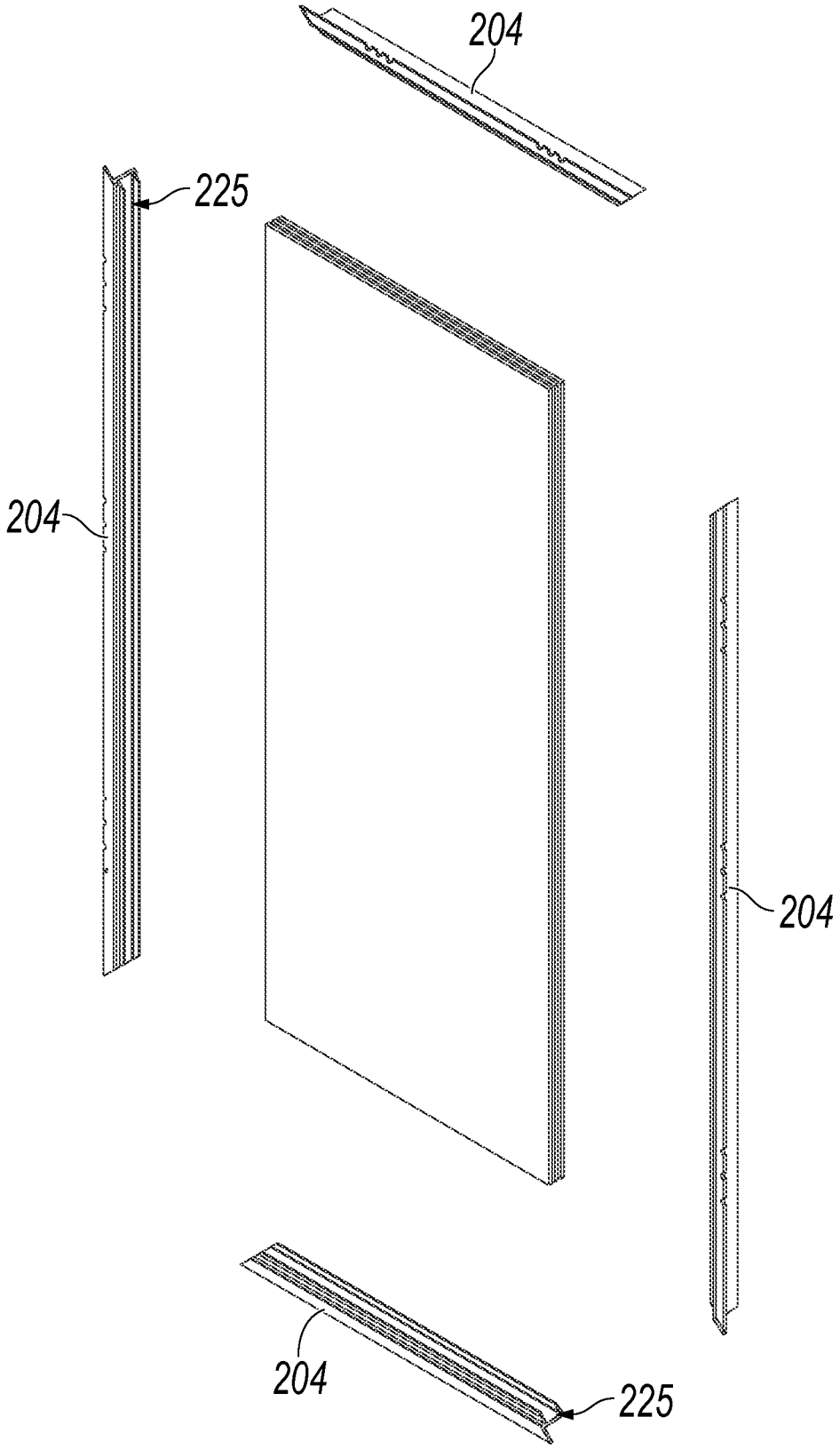
FIG. 13 is a partially exploded view of the sealed glass unit assembly of FIG. 7.

FIG. 13 is a partially exploded view of the sealed glass unit assembly of FIG. 7. Subframe 200 is formed by installing subframe rails 204 on all of the edges of sealed glass unit 200. A channel 225 of each of subframe rails 204 receives an edge of sealed glass unit 200. Each of subframe rails 204 can be secured to adjacent subframe rails 204 with screws or other fasteners.

Figure 14:
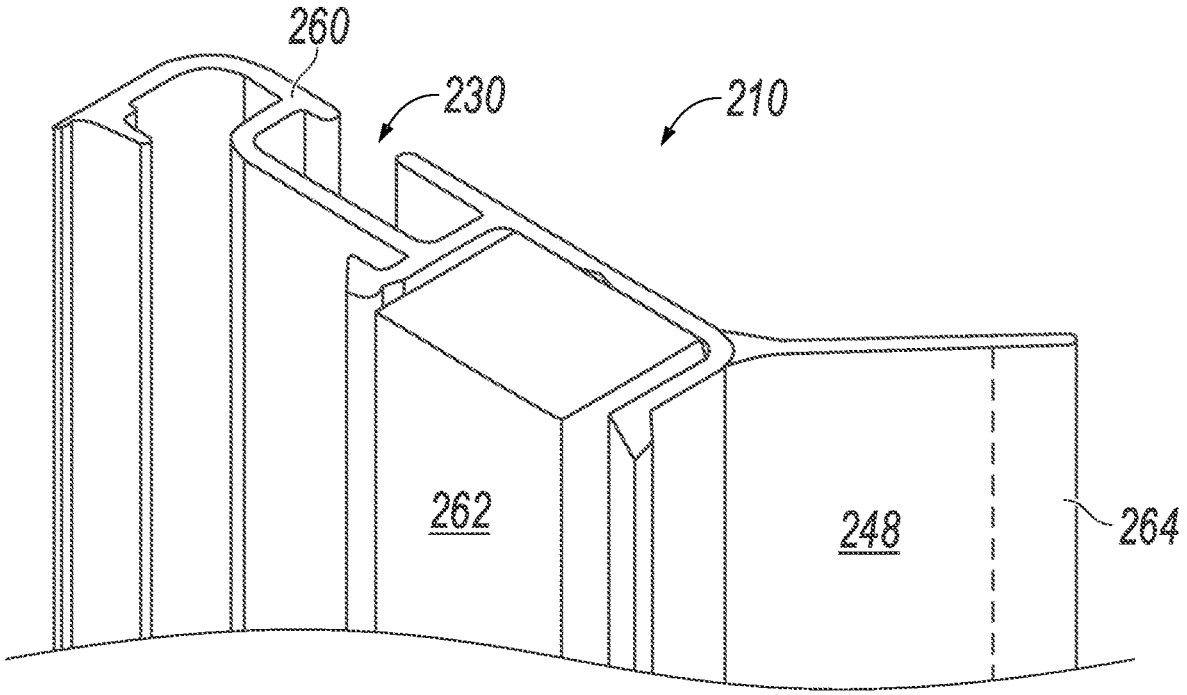
FIG. 14 is a perspective view of the back cover of FIG. 7.

FIG. 14 is a perspective view of back cover 210 of FIG. 7. Back cover 210 includes body 260 and blade 248. Body 260 defines slot 230. A block 262 is installed on body 260. Block 262 can be foam. Slot 230 can receive a gasket (for example, gasket 244 shown in FIG. 12).

Figure 15:
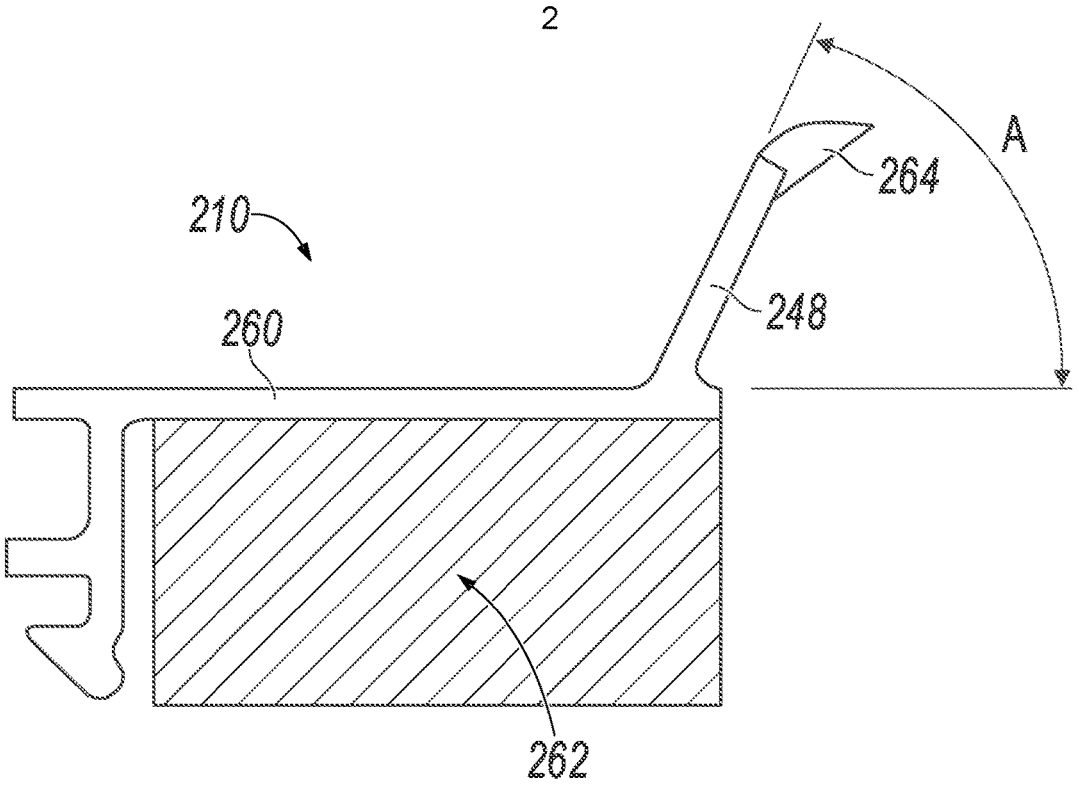
FIG. 15 is a detail view of the blade of the back cover of FIG. 14.

FIG. 15 is a detail view of blade 248 of back cover 210. Blade 248 extends at an angle A relative to body 260. In one implementation, angle A is about 63 degrees. Blade 248 includes distal portion 264. Distal portion 264 can be made of a material that is more flexible material than the rest of blade 248 and body 260. In one example, distal portion 264 is a PVC extrusion with a specific gravity of 1.42, a durometer hardness of 83, and a flexural modulus of 3100 MPa.

In some implementations, back cover 210 is co-extruded from two or more polymeric materials. For example, distal portion 264 can be extruded from one polymeric material and the rest of back cover 210 can be extruded from another polymeric material. In one implementation, distal portion 264 is a PVC elastomer. In some implementations, distal portion 264 is a flexible PVC and the rest of back cover 210 is a rigid PVC, coextruded as a single plastic piece.

When back cover 210 is installed on the rail system, distal tip 264 of blade 248 may contact and bear against an outer surface of the rail system. For example, referring again to FIG. 12, distal tip 264 contacts outer surface 250 of subframe rail 204 (distal tip 264 is shown in further detail in FIG. 15). Blade 248 can serve as a thermal break for cold air inside of the display case enclosure, which may inhibit condensation of the subframe rails 204 or other surfaces of display case door 100.

Figure 16:
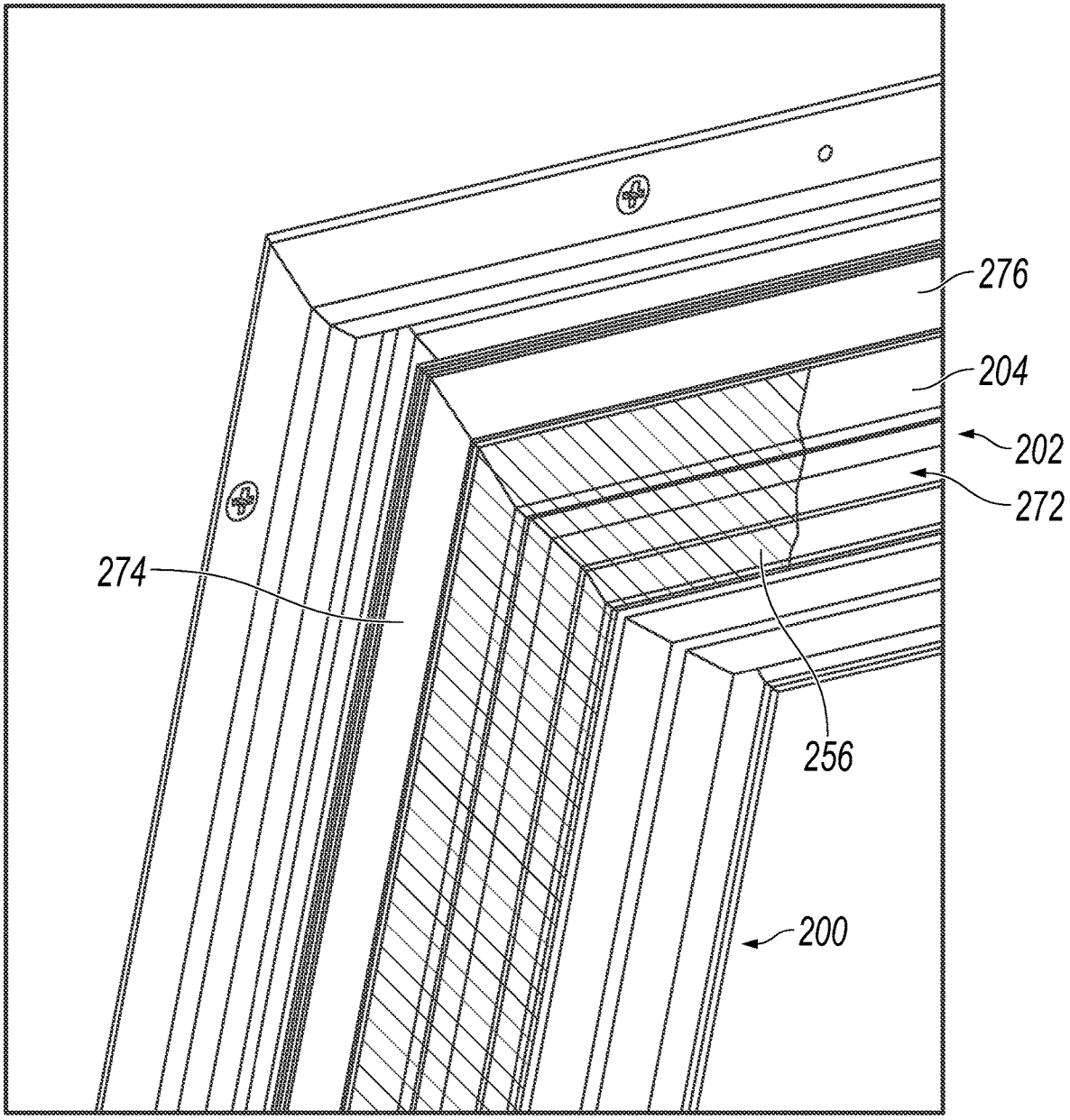
FIG. 16 illustrates a SGU assembly with a thermally conductive tape on a front surface of a subframe rail of the SGU assembly.

In some implementations, a thermally conductive material is applied to a front surface of a subframe rail. FIG. 16 illustrates a SGU assembly with a thermally conductive tape on a front surface of a subframe rail of the SGU assembly. Thermally conductive tape 256 is installed on front surface 272 of subframe rail 204. Thermally conductive tape 256 can be installed on the front surface of a subframe around the entire perimeter of the subframe.

Thermally conductive tape 256 can be in contact with the front edge of the adjacent rails of door frame 104. In some implementations, the rails of the door frame are made of an aluminum alloy or other thermally conductive material. In certain implementations, thermally conductive tape can be applied over a portion of a front rail of the door frame. Thus, in this example, an outer edge of thermally conductive tape 256 can be applied on side rail 274 and top rail 276.

As illustrated in FIG. 16, thermally conductive tape 256 can be applied up to the edge of the front glass pane of sealed glass unit 200. Thus, the tape can cover the entire exposed front surface of subframe 202. In other implementations, a thermally conductive material covers only a portion of the exposed front surface of a subframe.

In one implementation, thermally conductive tape 256 is an aluminum tape with a thermally conductive adhesive. In another implementation, thermally conductive tape 256 is a copper tape with a thermally conductive adhesive. Other examples of thermally conductive materials include acrylic tape, or a thermally conductive coating, such as a thermally conductive epoxy. In certain implementations, a surface rail is covered with a tape that includes a closed cell PVC foam of light density with a PVC backing, with an acrylic adhesive on one side.

Figure 17B:
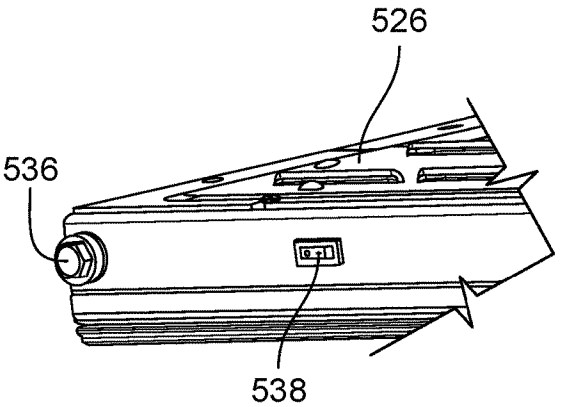
FIGS. 17A and 17B illustrate an exemplary display case door according to an implementation of the present disclosure.
Figure 17A:
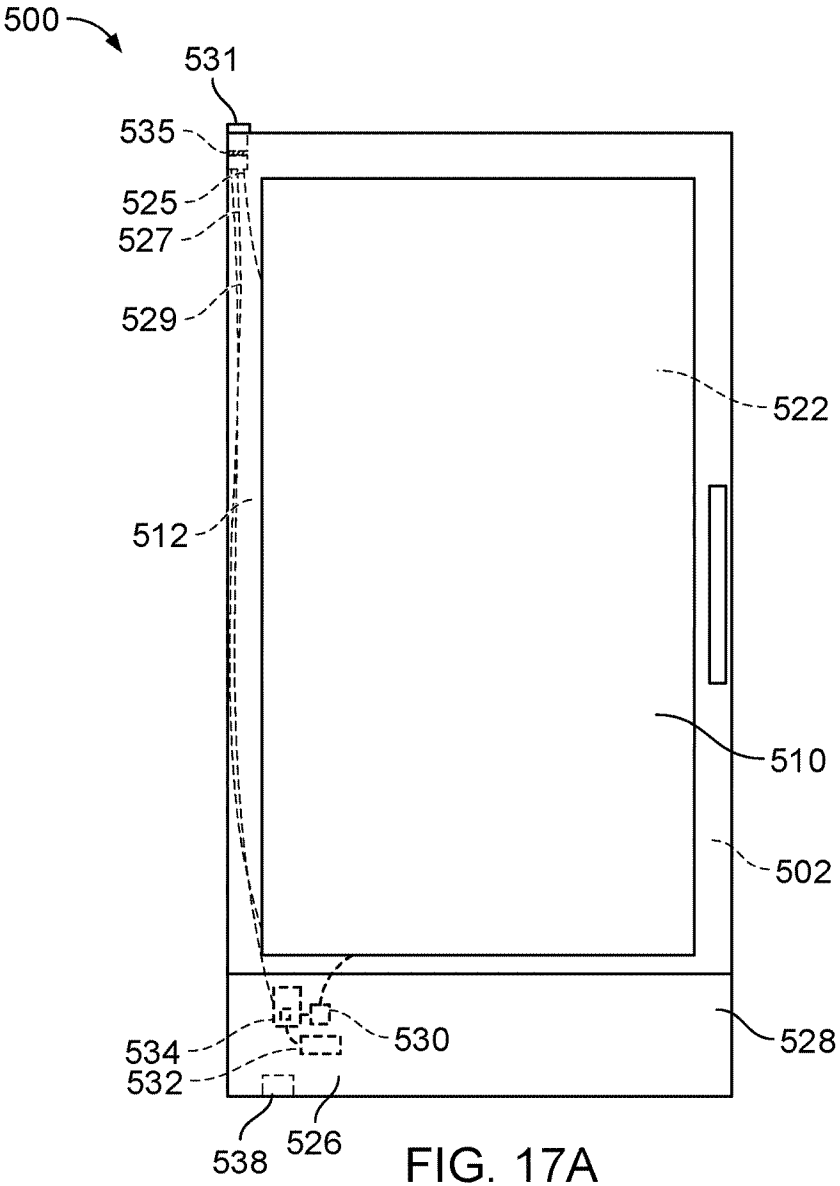

FIG. 17A illustrates an exemplary display case door 500 according to an implementation of the present disclosure. Display case door 500 includes hinge pin 531. In this example, display case door includes quick disconnect plug 535. Quick disconnect plug 535 is electrically coupled to a power cable 525, a ground wire 527, and one or more electrical wires 529 coupled to electronic display 510 or to circuitry module 526. In some implementations, power cable 525 includes at least a power supply cable, a ground cable, and a detachable ground lug in one wiring assembly with one plug on each end of the wiring assembly. For example, the electronic display 510 can have a male component while the door frame 502 can have the female component. The male component and the female component can be referred to as a pin and socket connection. The plug will have all the power, ground and neutral joined at the plug.

Similar to the display case door shown in FIGS. 1-6 above, display case door 500 includes a transparent panel assembly 522 and a door frame 502 that receives and secures an electronic display 510 to cover transparent panel assembly 522. Electronic display 510 can be attached to door frame 502 using mounting blocks 108, left side hinge brackets 112, and right side brackets 114 as described in FIGS. 1-6 above. Electronic display 510 has a height that is less than the interior height of frame 502, leaving a space 528 between the bottom of door 500 and the bottom edge of the electronic display 510 to place electrical components with door 500. For example, display case door 500 includes circuitry module 526 disposed under the electronic display 510. Circuitry module 526 includes at least a media player 530 in electronic communication with electronic display 510. Media player 530 controls media content presented on display 510. Circuitry module 526 can also include a power hub 532 and a power converter 534. Circuitry module 526 is releasably coupled to door frame 502.

In certain implementations, circuitry module 526 can include one or more quick disconnect plugs. A quick disconnect plug can be attached to the first end of a control cable. The quick disconnect plug can also attached to power cable 529. The quick disconnect plug may include a power, audio, visual, or ground wire.

Referring also to FIG. 17B, display case door 500 includes a power switch 538 secured to door frame 512 near torque rod 536. Power switch 538 is electrically coupled to electronic display 510 to turn on and off the power to electronic display 510. Power switch 538 resides on bottom of door frame 512 and can be in line with power cable 525. Power switch 538 resides on door frame 512 to prevent customers or maintainers from inadvertently cycling power to display case door 500.

Figure 18A:
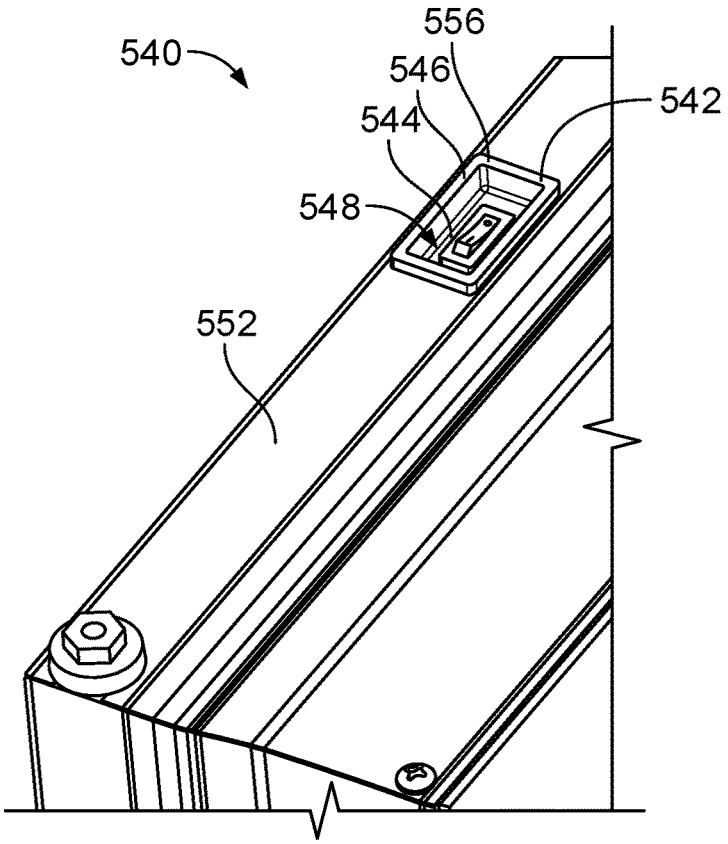
FIG. 18A illustrates an inset power switch on a bottom surface of a display case door.

In some implementations, a power switch for a display case door is inset into the door frame below a bottom surface of the frame. FIG. 18A is a perspective view of a power switch on a bottom surface of a door. The switch assembly 540 can include a molded bezel cover 542 with the power switch 544 inset into the door frame 512. The wires connected to the power switch 544 can be potted to water proof the switch. The molded bezel cover 542 on the power switch 544 may also protect the power switch 544 from damage when installed on the door.

Figure 18B:
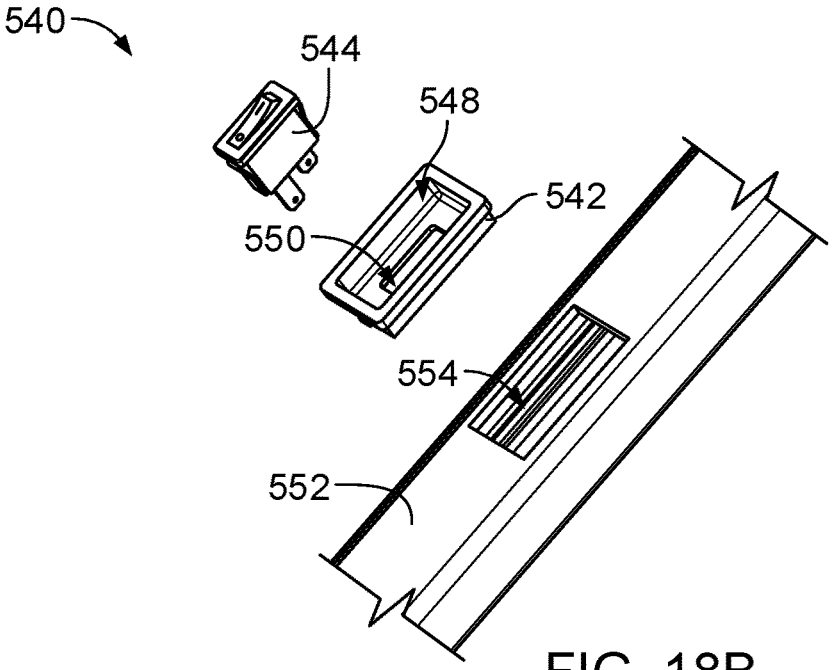
FIG. 18B is an exploded view of the switch assembly of FIG. 17A.

FIG. 18B is an exploded view of the 540 switch assembly of FIG. 18A. Molded bezel cover 542 includes rim 546, pocket 548, and aperture 550. Bottom rail 552 includes opening 554. Molded bezel cover 542 is installed in opening 554. Power switch 544 is installed in aperture 550 of molded bezel cover 542. Power switch 544 may reside in pocket 548. As shown in FIG. 18A, power switch 544 may be recessed relative to the exterior surface 556 of rim 546.

Referring again to FIG. 18A, power cables 525 can provide electrical power to electronic display 510 and power converter 534. Power converter 534 receives alternating current (AC) power from power cable 525 and converts the AC power to direct current (DC) power. For example, power converter 534 converts 110V AC power to 5V DC power. Power converter 534 is electrically connected to one or more media players 530. Power converter 534 is arranged inside display case door 500.

Figure 19:
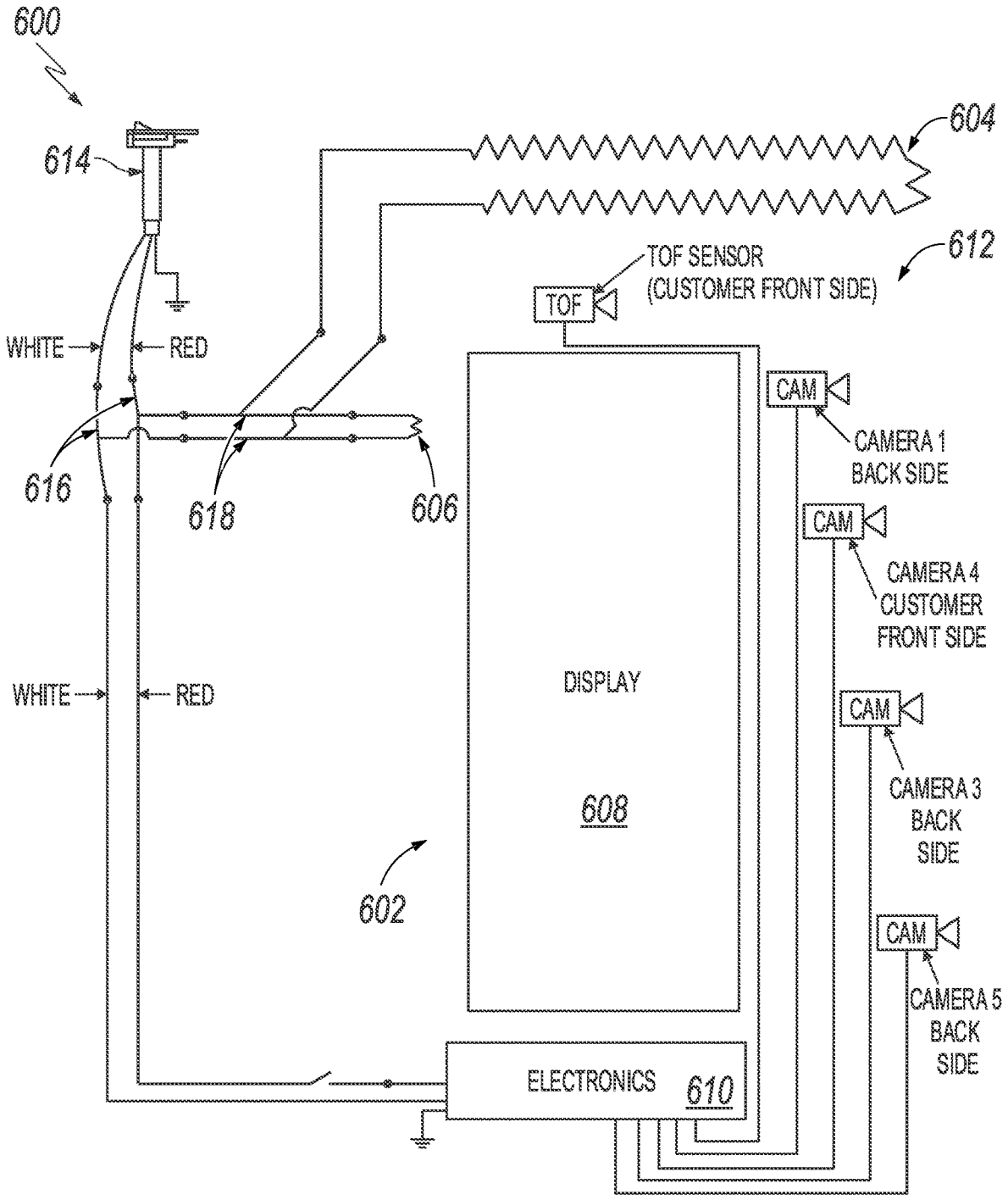
FIG. 19 is a schematic for a wire harness for a display case door including an electronic display according to some implementations.

FIG. 19 is a schematic for a wire harness for a display case door including an electronic display. Display case door 600 includes electronic display assembly 602, door rail heaters 604, and glass heaters 606. Electronic display assembly 602 includes display 608, electronics unit 610, and sensors 612.

Electrical power is provided to display case door 600 through hinge pin connector 614. Power lines can be paired such that different branches of the power lines provide power to each of the loads of display case door 600. Splitters 616 branch electrical power between electronic display assembly 602 and the heaters. Splitters 618 branch electronic power between door rail heaters 604 and glass heaters 606.

Figure 20:
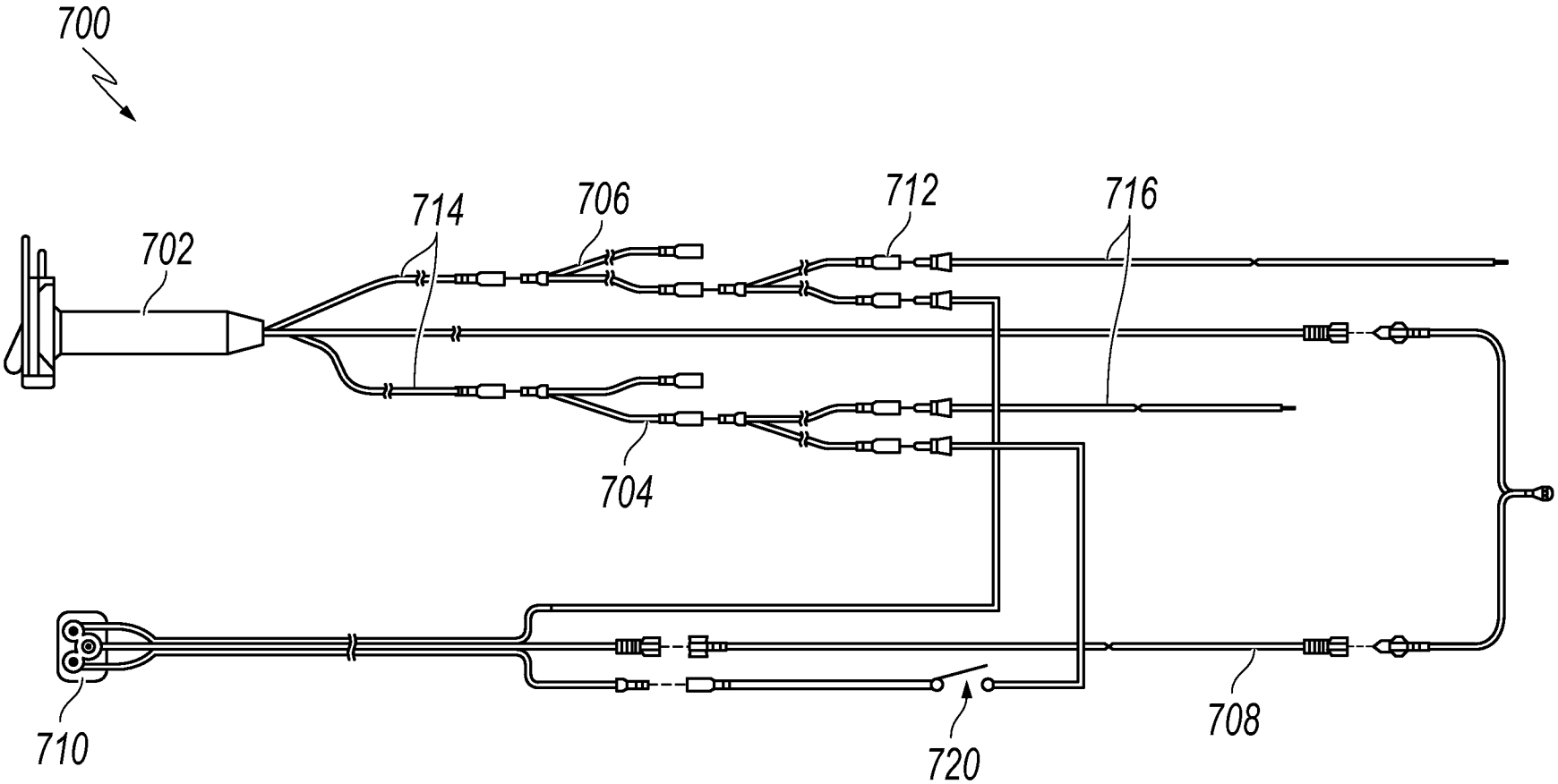
FIG. 20 is schematic diagram of a wire harness.

FIG. 20 is schematic diagram of a wire harness. Wire harness 700 includes hinge pin connector 702, red wire assembly 704, white wire assembly 706, ground wire assembly 708, and electronic display connector 710. Each of the wires on red wire assembly 704, white wire assembly 706, and ground wire assembly 708 include connectors 712. All hot connections can use female connectors so that users are not exposed to live wire.

Wires from red wire assembly 704 and white wire assembly 706 can be paired and attached to individual loads, including door rail heaters and glass heaters. In this example, one pair of wires forms a branch 714 that supplies power to door rail heaters 714 and another pair of wires forms a branch that supplies power to glass heaters 716.

Power is passed from frame to door through hinge pin connector 702. Power can then be split into two or more connections. In one implementation, power is split into two connection so that one circuit powering the door heaters. The other connection than be split again into two connections to power the display and glass heaters.

Switch 720 can be used to turn power on or off to the electronic display. Connectors 712 can be used (e.g., by maintenance personnel) to connect and disconnect power individually to the door rail heaters or glass heaters. In some implementations, a field service technician can power/depower each of electronic display, door rail heater, and glass heater individually. In some implementations, a switch is provided on one or more of the lines to some or all of the door rail heaters or glass heaters.

In some implementations, wire harness 700 is provided in a left hand configuration and a right hand configuration. One of the configurations can be used on each side of the electronic display.

Figure 21:
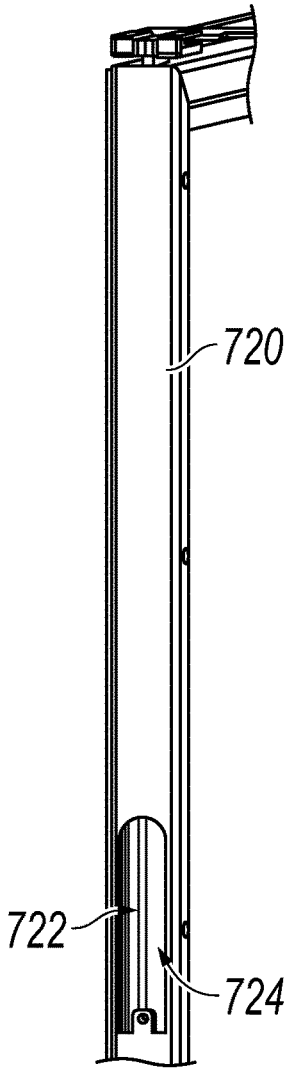
FIG. 21 is a perspective view of an access opening in a door frame rail.

FIG. 21 is a perspective view of an access opening in a door frame rail. Rail 720 includes access opening 722. Access opening 722 provides access to wireway 724 in rail 720.

Figure 22:
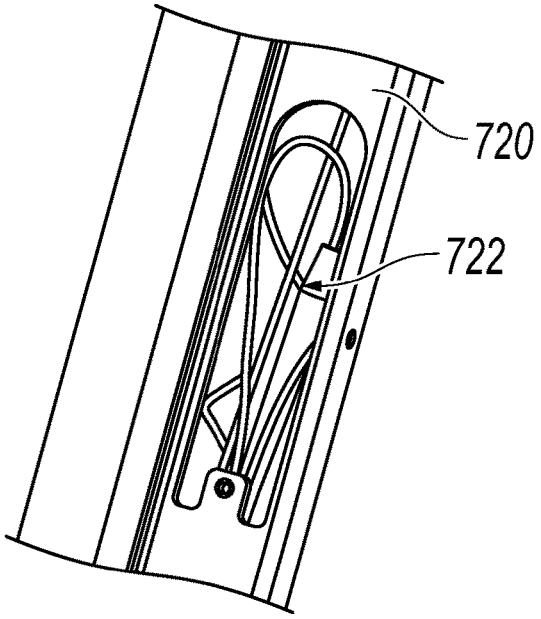
FIG. 22 is a perspective view illustrating access to wires in a wireway of a rail.

FIG. 22 is a perspective view illustrating access to wires in a wireway of a rail. The access opening can allow a user (e.g., maintenance personnel) to maintain or change the configuration of a wire harness assembly in the wireway.

In this example, rail 720 is on the hinge-side of a display case door. In other implementations, access openings are provided in other locations on a display case door.

Figure 23:
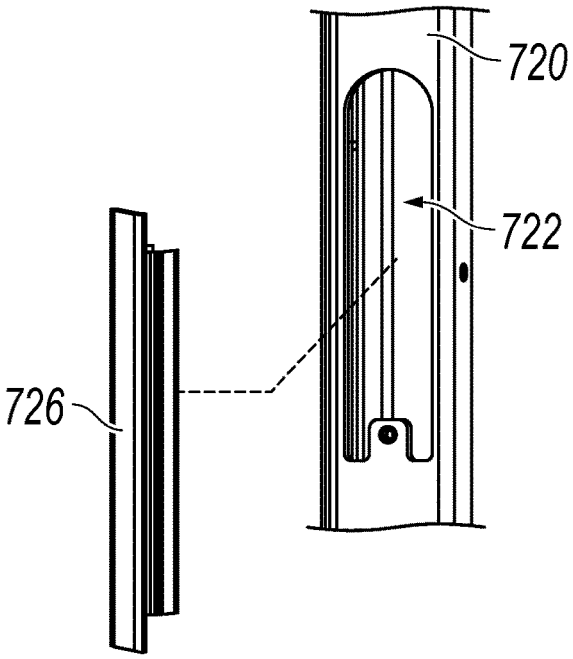
FIG. 23 is a detail view of the access opening shown in FIG. 21.

FIG. 23 is a detail view of the access opening shown in FIG. 21. Access opening 722 includes receives access cover 726. Access cover 726 can snap into access opening 722.

Figure 24:
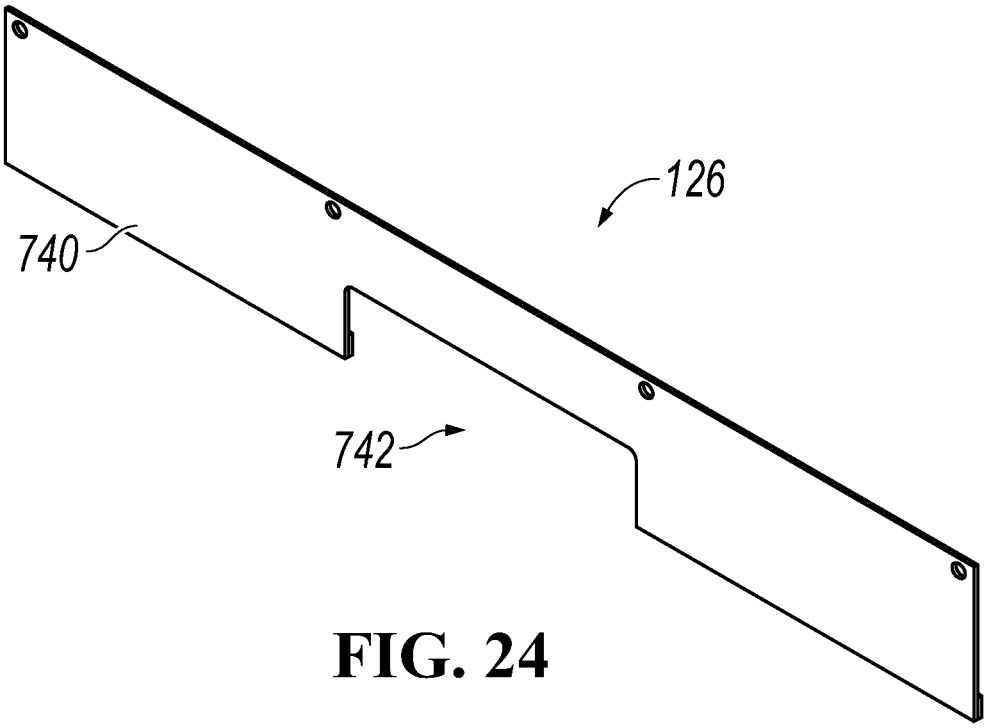
FIG. 24 is a perspective view illustrating a top bezel for a display case door.

FIG. 24 is a perspective view illustrating top bezel for a display case door. Top bezel 126 includes plate 740 and cutout 742. As illustrated in FIG. 3, cutout allows for top sensor 134 to extend from the front of electronic display 102. In one implementation, top sensor 134 is a TOF sensor.

Figure 25:
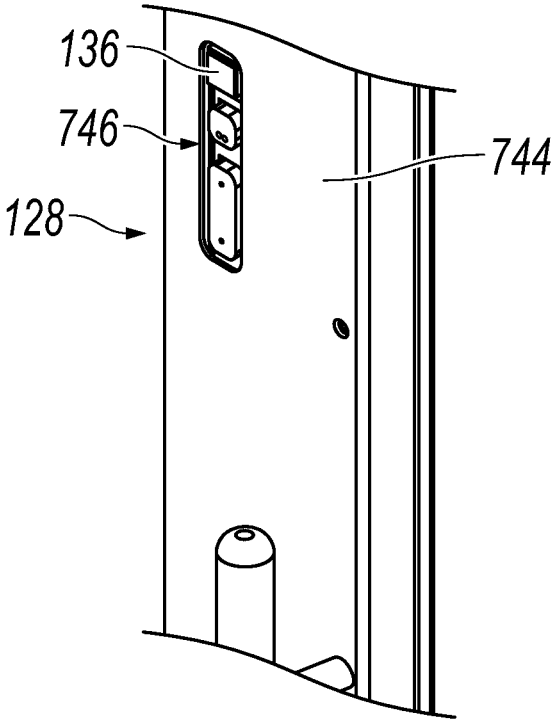
FIG. 25 is a perspective view illustrating a right side bezel for a display case door.

FIG. 25 is a perspective view illustrating right side bezel for a display case door. Right bezel 128 includes plate 744 and cutout 746. In this example, cutout is in the form of an opening. Cutout 746 allows for handle-side sensor 136 to sense the space in front of display case door 100.

While a number of examples have been described for illustration purposes, the foregoing description is not intended to limit the scope of the invention, which is defined by the scope of the appended claims. There are and will be other examples and modifications within the scope of the following claims. Furthermore, one of skill in the art would appreciate that features described in reference to a specific embodiment are not limited to that embodiment and can be interchanged with features of other embodiments.

What is claimed is:

1. A display case door comprising:

a sealed glass unit assembly comprising:

a sealed glass unit; and a subframe extending about and coupled to the sealed glass unit, the subframe comprising a set of two or more subframe rails configured to hold the sealed glass unit;

a door frame coupled to the subframe and configured to support the sealed glass unit assembly in the door frame; and an electronic display coupled to the door frame in front of the sealed glass unit, wherein the door frame is configured to couple with a display case enclosure in an opening of the display case enclosure.

2. The display case door of claim 1, wherein at least one of the subframe rails defines a channel configured to receive an edge of the sealed glass unit.

3. The display case door of claim 1, wherein:

at least one of the subframe rails comprises a front rim, and the front rim is secured to the door frame.

4. The display case door of claim 3, wherein:

the door frame comprises one or more rails, at least one of the rails of the door frame comprises an inner rim, and the front rim of at least one of the subframe rails is coupled to the inner rim.

5. The display case door of claim 1, wherein:

at least one of the subframe rails comprises high-loaded polymer, and the door frame comprises one or more rails comprising an aluminum alloy.

6. The display case door of claim 1, wherein:

at least one of the subframe rails comprises a front rim and defines a channel, the channel is configured to receive an edge of the sealed glass unit, and the front rim extends outwardly from the channel and is coupled to the door frame.

7. The display case door of claim 1, wherein:

the door frame further comprises a back cover coupled to at least one of the subframe and the door frame, and the back cover comprises a slot configured to hold a gasket such that the gasket contacts a sealing surface on the display case enclosure when the display case door is installed on the display case enclosure.

8. The display case door of claim 1, wherein at least a portion of the sealed glass unit is recessed relative to a sealing surface of the display case enclosure with the display case door installed on the display case enclosure.

9. The display case door of claim 1, further comprising a back cover, the back cover comprising:

a body coupled with at least one of the subframe and the door frame, the body defining a slot configured to receive a gasket; and a blade extending from the body, wherein a distal portion of the blade is configured to contact an outer surface of at least one of the subframe rails when the back cover is installed on at least one of the subframe and the door frame.

10. The display case door of claim 1, further comprising a thermally conductive material at least partially covering a front surface of at least one of the two or more subframe rails.

11. The display case door of claim 1, further comprising one or more bezels coupled to the door frame, wherein:

the electronic display comprises one or more sensors along an edge of the electronic display, and at least one of the bezels defines a cutout for at least one of the one or more sensors.

12. The display case door of claim 1, further comprising one or more cable assemblies configured to supply electrical power to the electronic display and one or more heaters for the display case door, wherein at least one of the cable assemblies comprises a switch operable by a user to turn off power to the electronic display.

13. The display case door of claim 1, further comprising one or more cable assemblies configured to supply electrical power to the electronic display and one or more heaters for the display case door, wherein at least one of the subframe rails comprises a service access opening for at least one of the cable assemblies.

14. The display case door of claim 1, wherein the display case door comprises one or more heater wires coupled to at least one of the one or more subframe rails.

15. A rail system for a display case door, comprising:

a rear rail configured to hold an edge of a sealed glass unit of the display case door; and a front rail coupled to the rear rail, the front rail comprising one or more brackets configured to couple with an outer edge of an electronic display, wherein at least one of the front rail and rear rail is configurable to couple with a gasket such that the gasket contacts a sealing surface on a display case enclosure with the display case door coupled to the display case enclosure, and wherein the front rail is arranged relative to the rear rail such that the electronic display overlaps with the seal glass unit with the sealed glass unit coupled to the rear rail and with the electronic display coupled to the front rail.

16. The rail system of claim 15, wherein:

the rear rail is included in a subframe for the sealed glass unit, the front rail is included in a door frame, and the subframe is configurable to couple with the door frame to support the sealed glass unit in the door frame.

17. The rail system of claim 16, further comprising a back cover, the back cover comprising:

a body coupled with at least one of the rear rail and the front rail, the body defining a slot configured to receive a gasket; and a blade extending from the body, wherein a distal portion of the blade is configured to contact an outer surface of the rear rail when the back cover is installed on at least one of the subframe and the door frame.

18. The rail system of claim 15, wherein the rear rail defines a channel configured to receive an edge of the sealed glass unit.

19. The rail system of claim 18, wherein the rear rail comprises a front rim extending outwardly from the channel, wherein the front rail is configured to couple with the front rim.

20. The rail system of claim 15, wherein:

the rear rail comprises high-loaded polymer, and the front rail comprises an aluminum alloy.

21. The rail system of claim 15, further comprising a thermally conductive material disposed on at least a portion of a front surface of the rear rail.

22. A method of making a display case door, comprising:

installing two or more subframe rails on a sealed glass unit to form a subframe around the sealed glass unit;

coupling each of at least one of the two or more subframe rails to a corresponding rail of a door frame to install the sealed glass unit in the door frame; and coupling an electronic display to one or more brackets attached to the door frame such that the electronic display is positioned in front of the sealed glass unit.

23. The method of claim 22, wherein:

at least one of the two or more subframe rails comprises a channel, installing the two or more subframe rails on the sealed glass unit to form a subframe around the sealed glass unit comprises installing an edge of the sealed glass unit in the channel.

* * * * *